US009486373B2

(12) United States Patent
Lambarth et al.

(10) Patent No.: US 9,486,373 B2
(45) **Date of Patent: *Nov. 8, 2016**

(54) RECONFIGURABLE PATIENT SUPPORT

(71) Applicant: Stryker Corporation, Kalamazoo, MI (US)

(72) Inventors: Clifford Edwin Lambarth, Portage, MI (US); Jason James Wroblewski, Kalamazoo, MI (US); Brandon David Naber, Portage, MI (US); Alfred James Dacy, IV, Mendon, MI (US); Thomas Alan Puvogel, Kalamazoo, MI (US); Ross Timothy Lucas, Paw Paw, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/206,257

(22) Filed: Mar. 12, 2014

(65) Prior Publication Data

US 2014/0259420 A1 Sep. 18, 2014

Related U.S. Application Data

(60) Provisional application No. 61/781,308, filed on Mar. 14, 2013, provisional application No. 61/781,844, filed on Mar. 14, 2013.

(51) Int. Cl.
*A61G 5/10* (2006.01)
*A61G 7/015* (2006.01)
(Continued)

(52) U.S. Cl.
CPC ..... *A61G 7/015* (2013.01); *A61G 1/017* (2013.01); *A61G 1/0275* (2013.01);
(Continued)

(58) Field of Classification Search
CPC .... A61G 7/015; A61G 5/066; A61G 1/0275; A61G 1/0567; A61G 1/017; A61G 5/1059; A61G 5/061; A61G 5/006; A61G 5/1075; A61G 2007/165; A61G 5/107; A61G 1/025; A61G 5/1067; A61G 1/0225
See application file for complete search history.

(56) References Cited

U.S. PATENT DOCUMENTS 3,967,328 A 7/1976 Cox
4,255,823 A 3/1981 Boyer et al.
(Continued)

FOREIGN PATENT DOCUMENTS

EP 0786396 B1 9/2001
EP 1212025 A1 6/2002
(Continued)

OTHER PUBLICATIONS

PCT International Search Report regarding Application No. PCT/US2014/026370 filed Mar. 13, 2014, a counterpart to U.S. Appl. No. 14/206,257.
(Continued)

*Primary Examiner* — Robert G Santos
*Assistant Examiner* — Myles Throop
(74) *Attorney, Agent, or Firm* — Warner Norcross & Judd LLP

(57) ABSTRACT

A patient support includes a base, a deck for supporting a patient, and a lift mechanism supporting the deck on the base and configured to adjust the orientation of the deck while allowing the head and foot sections of the deck to be articulated with respect to the seat section of the deck.

14 Claims, 42 Drawing Sheets

(51) Int. Cl.

| | |
|---|---|
| ***A61G 5/00*** | (2006.01) |
| ***A61G 5/06*** | (2006.01) |
| ***A61G 1/017*** | (2006.01) |
| ***A61G 1/056*** | (2006.01) |
| *A61G 1/02* | (2006.01) |
| *A61G 7/16* | (2006.01) |

(52) U.S. Cl.

CPC ..... *A61G 1/0567* (2013.01); *A61G 5/006* (2013.01); *A61G 5/061* (2013.01); *A61G 5/066* (2013.01); *A61G 5/1059* (2013.01); *A61G 1/025* (2013.01); *A61G 1/0225* (2013.01); *A61G 5/107* (2013.01); *A61G 5/1067* (2013.01); *A61G 5/1075* (2013.01); *A61G 2007/165* (2013.01)

(56) References Cited

U.S. PATENT DOCUMENTS

| | | | | |
|---|---|---|---|---|
| 4,451,945 | A | 6/1984 | Heinz et al. | |
| 4,674,584 | A * | 6/1987 | Watkins | A61G 5/061 180/8.2 |
| 4,813,088 | A | 3/1989 | DiMatteo et al. | |
| 5,135,350 | A | 8/1992 | Eelman et al. | |
| 5,438,722 | A | 8/1995 | Jayamanne | |
| 5,613,255 | A * | 3/1997 | Bish et al. | 5/611 |
| 5,790,997 | A | 8/1998 | Ruehl | |
| 7,581,265 | B1 | 9/2009 | Bourgraf et al. | |
| 7,887,113 | B2 | 2/2011 | Lambarth et al. | |
| 7,918,473 | B2 | 4/2011 | Yao | |
| 8,056,163 | B2 | 11/2011 | Lemire et al. | |
| 8,104,121 | B2 | 1/2012 | Bourgraf et al. | |
| 8,359,685 | B2 | 1/2013 | Patwardhan | |
| 8,439,416 | B2 | 5/2013 | Lambarth et al. | |
| 8,459,660 | B2 | 6/2013 | Livingston | |
| 8,864,205 | B2 | 10/2014 | Lemire et al. | |
| 2002/0056162 | A1* | 5/2002 | Flynn et al. | 5/611 |
| 2003/0116927 | A1* | 6/2003 | Quigg | 280/5.22 |
| 2005/0172405 | A1* | 8/2005 | Menkedick et al. | 5/618 |
| 2006/0087166 | A1* | 4/2006 | Trippensee et al. | 297/338 |
| 2007/0007806 | A1* | 1/2007 | Anthony | 297/338 |
| 2007/0017029 | A1* | 1/2007 | Wurdeman | 5/618 |
| 2007/0114079 | A1* | 5/2007 | Chao | A61G 5/042 180/65.1 |
| 2007/0182220 | A1* | 8/2007 | Walkinshaw | A61G 1/013 297/118 |
| 2010/0017964 | A1 | 1/2010 | Kruse | |
| 2010/0117312 | A1 | 5/2010 | Walkingshaw et al. | |
| 2010/0176618 | A1 | 7/2010 | Souke et al. | |
| 2012/0139197 | A1* | 6/2012 | Livingston | A61G 5/061 280/5.22 |
| 2013/0341984 | A1* | 12/2013 | Olesen | 297/344.15 |
| 2014/0265181 | A1* | 9/2014 | Lambarth et al. | 280/28.5 |
| 2014/0325759 | A1* | 11/2014 | Bly et al. | 5/611 |
| 2015/0115638 | A1 | 4/2015 | Lambarth et al. | |

FOREIGN PATENT DOCUMENTS

| | | | |
|---|---|---|---|
| EP | 0744934 | B1 | 12/2002 |
| EP | 0932385 | B1 | 3/2004 |
| WO | 0239944 | A3 | 5/2002 |
| WO | 2005056376 | A1 | 6/2005 |
| WO | 2008127944 | A1 | 10/2008 |
| WO | 2009076630 | A1 | 6/2009 |
| WO | 2010025387 | A2 | 3/2010 |
| WO | 2011100556 | | 8/2011 |
| WO | 2013096861 | A1 | 6/2013 |
| WO | 2013192411 | A2 | 12/2013 |

OTHER PUBLICATIONS

PCT International Written Opinion regarding Application No. PCT/US2014/026370 filed Mar. 13, 2014, a counterpart to U.S. Appl. No. 14/206,257.

* cited by examiner

RECONFIGURABLE PATIENT SUPPORT

CROSS-REFERENCE TO RELATED APPLICATION

This application claims the benefit of U.S. Provisional Patent Application No. 61/781,308, filed Mar. 14, 2013, and U.S. Provisional Patent Application No. 61/781,844, filed Mar. 14, 2013, which are both incorporated herein by reference in their entirety and commonly owned by Stryker Corporation of Kalamazoo, Mich.

TECHNICAL FIELD AND BACKGROUND OF THE INVENTION

The present invention generally relates to a patient support, and more specifically to a patient support that provides multiple functions and that can be configured as a chair or an emergency cot.

Patients are handled by a wide range of patient supports or equipment, each with its own functionality. For example, patient supports or equipment may include stair chairs, both powered and non-powered, cots, stretchers, and the like. Each has a configuration that is suited to the particular need of the caregiver or attendant. For example, when a patient needs to transported down stairs, the stair chair has a chair-like configuration and may include a treaded track to help lowering the patient down stairs. A cot on the other hand typically has a generally horizontal deck to support a patient in a supine position. However, when handling a patient, the patient often needs to be transferred from one patient support to another patient support, which can add stress to the patient and also to the caregivers.

SUMMARY OF THE INVENTION

The present invention provides a patient support that may be configured between a chair configuration, such as a stair chair, and a cot. The present invention also provides a patient support with a compact lift mechanism that can be used to raise the deck of the patient support and further tilt the deck while allowing independent articulation of the foot and head sections of the deck. The patient support of the present invention also provides a stair chair with a caster track transition to facilitate handling of the patient.

In one form of the invention, the patient support includes base, a deck for supporting a patient, the deck having a head end and a foot end, a lift mechanism supporting the deck on the base, with the lift mechanism a central pivot axis about which the lift mechanism collapses or extends to lower or raise the deck. Further, the patient support has center gravity extending through the central pivot axis of the lift mechanism when the deck is in a fully raised position and which is off-set toward the head end of the deck when the deck is a lowered position.

In one aspect, the lift mechanism comprises an X-frame lift mechanism.

In another aspect, the X-frame comprises first and second X-frames with each of the X-frames having upper ends and lower ends and with the upper ends of the first X-frame pivotally coupled to the lower ends of the second frame.

In addition, each of the first and second X-frames may have telescoping legs. For example, the upper ends of the second X-frame may be provided by its respective telescoping legs. In addition, the lower ends of the first X-frame may be provided by its respective telescoping legs. In this manner, the telescoping legs allow the X-frames to vary the angle of the deck to thereby tilt the deck relative to the base.

In another aspect, the deck comprises an articulatable deck having a head section, a seat section, and a foot section with a lift mechanism coupled with the seat section, with the head and foot sections independently articulatable with respect to the deck section and the lift mechanism.

Further, in any of the above patient supports, the deck section may include a head section or foot section with the head section or foot section including telescoping portions thereby extending the length of the deck.

Further in any of the above, the deck section may include a seat section, a head section, and a foot section, with at least one section comprising a perimeter frame and a pad supported by the frame, wherein the pad is exposed on both sides of the section.

In a further aspect, each section comprises a perimeter frame and a pad supported by each perimeter frame, wherein the pads are exposed on both sides of each section.

For example, the pad may comprise a core cushioning member and a base supporting said cushioning member, with both the base and cushioning member enveloped in a cover, such as a liquid impermeable cover, such as vinyl.

In another form of the invention, the patient support includes a base, a deck for supporting the patient, with the deck having a seat section, a head section articulatable relative to the seat section, and a foot articulatable relative to the seat section. The lift mechanism supports the deck on the base, and includes an X-frame with telescoping legs at one end. The lift mechanism is mounted to the seat section wherein the head section and foot section are each independently articulatable with respect to the deck section and the lift mechanism. Further, the lift mechanism is operable to tilt the seat section to thereby tilt the deck.

In one form, the X-frame comprises first and second X-frames with each of the X-frames having upper ends and lower ends with the upper ends of the first X-frame pivotally coupled to the lower ends of the second X-frame.

For example, each of the first and second X-frames may have telescoping legs. Further, the upper ends of the second X-frame may be provided by its respective telescoping legs.

In another aspect, the head section, foot section, and the seat section are reconfigurable between a generally horizontal configuration to form a cot configuration, and a folded configuration wherein the head section is generally vertical relative to the seat section and the foot section is generally vertical relative to the seat section to form a chair configuration.

In any of the above, the base may include a plurality of casters.

Further, in any of the above, the base may include a track.

When the base includes both the track and the casters, the casters may be mounted for movement between a ground engaging position and a non-grounding engaging position to allow the track to engage the ground.

In another aspect, the patient support further includes a drive train for driving the patient support relative to the ground (or stairs). For example, the drive train may drive a track or may drive a removably mounted pair of wheels.

In another form of the invention, a patient support includes a base, a deck for supporting the patient, a lift mechanism for supporting the deck on the base, and an electrically powered device at the patient support. The patient support also includes a wireless user actuatable device at the patient support for controlling the electrically powered device. For example, the electrically powered device may comprise a drive mechanism, for example, to drive a track mounted to the base or for raising or lowering the lift mechanism.

In another aspect, the deck has a seat section, a head section articulatable relative to the seat section and a foot section articulatable relative to the seat section when the drive mechanism is operable to the move the head section or the foot section.

In addition, the present invention provides a patient support that has a first configuration to provide a first functionality and which may be reconfigured to a second configuration to provide a second functionality.

In one form of the invention, a patient support system includes a first wheeled base for forming a part of a first patient support, a litter deck for supporting a patient, the deck having a seat section and an articulatable head or foot section and movably supported with respective to the first base to thereby form the support surface for the first patient support. A second wheeled base is provided for forming a part of a second patient support, with the litter deck releasably mounted with respective to the first base and transferable to the second base and configured to be releasably mounted with respective to the second base to thereby form the support surface for the second patient support.

In one aspect, the patient support system further includes a lifting mechanism for moving the litter deck relative to the first base when mounted with respective to the first base.

In addition, the lifting mechanism may comprise first and second pairs of X-frames, each of the pairs of X-frames having upper ends and lower ends, with the upper ends of the first pair of X-frames pivotally coupled to respective lower ends of the second pair of X-frames.

Optionally, each of the first and second pairs of X-frames may have telescoping legs wherein the lifting mechanism can tilt the deck with respect to the first base.

In another aspect, the second patient support may comprise a stair chair.

In yet another aspect, the first patient support may comprise a cot, and comprise a cot reconfigurable between a chair and a cot.

Further, in any of the above patient supports, the deck section may include a head section or foot section with the head section or foot section including telescoping portions thereby extending the length of the deck. In addition, the deck may have articulatable head and foot sections.

Further, in any of the above first patient supports, the deck may comprise an articulatable deck having an articulatable head section and an articulatable foot section, with a lifting mechanism coupled to the seat section wherein the head and foot sections are each independently articulatable with respect to the deck section and the lift mechanism.

In another form of the invention, a patient support includes wireless switches to allow control of the various accessories or drive mechanisms at the patient support and further allow communication between the attachable devices.

In another form of the invention, a stair chair includes a wheeled base; a frame mounted to the base and supporting at least one track; and a seat section supported by the frame. A foot section is pivotally mounted adjacent an edge of the seat section, and a head section is pivotally mounted adjacent an opposed edge of the seat section.

In one aspect, the seat, foot, and head sections may be releasably mounted to the frame and are removable without disassembly.

In another aspect, the base may include a plurality of casters.

In another aspect, the seat, foot, and head sections may be removable independently.

In yet another aspect, the seat, foot, and head sections may be removable as an assembly.

According to yet another aspect, the stairs chair is collapsible into a configuration so that is can be mounted onto another frame to form a cot.

In yet another form of the invention, an emergency medical cot includes a base, a deck for supporting a patient having a seat section, a head section articulatable relative to the seat section, and a foot section articulatable relative to the seat section. The deck is releasably mounted at the cot and is removable without disassembly. A lifting mechanism supports the deck on the base, which is configured to adjust the angular orientation of the deck while allowing the head section and the foot section to be articulated relative to the seat section.

In one aspect, the lifting mechanism comprises first and second pairs of X-frames, each of the pairs of X-frames having upper ends and lower ends, with the upper ends of the first pair of X-frames pivotally coupled to respective lower ends of the second pair of X-frames.

In another aspect, each of the first and second pairs of X-frames has telescoping legs wherein the lifting mechanism can tilt the deck with respect to the first base.

In another form, a patient support system includes a first wheeled base for forming a part of a first patient support, a litter frame movably mounted to the first wheeled base, and a second wheeled base for forming a part of a second patient support. A frame is mounted to the second base, and a litter deck is mounted to the litter frame for supporting a patient, the litter deck configured in chair configuration, the base, the frame and the deck being reconfigurable to lie in a generally horizontal configuration and adapted to be mounted to the litter frame to thereby form a patient support surface for the first patient support.

In addition, the patient support system may further include a lifting mechanism for moving the litter frame relative to the first base.

In yet another aspect, the deck may have a seat section, and articulatable head and foot sections.

For example, the second patient support may comprise a stair chair. And, the first patient support may comprise a cot.

In one form, the lift mechanism may comprises an X-frame and further may comprise first and second X-frames with each of the X-frames having upper ends and lower ends with the upper ends of the first X-frame pivotally coupled to the lower ends of the second X-frame.

For example, each of the first and second X-frames may have telescoping legs. Further, the upper ends of the second X-frame may be provided by its respective telescoping legs.

In another aspect, the head section, foot section, and the seat section are reconfigurable between a generally horizontal configuration to form a cot configuration, and a folded configuration wherein the head section is generally vertical relative to the seat section and the foot section is generally vertical relative to the seat section to form a chair configuration.

In any of the above, each base may include a plurality of casters.

In yet another embodiment, a patient support includes a deck for supporting a patient, a lift mechanism supporting the deck, and a powered indicator at the patient support operable to illuminate a portion of the patient support.

In one aspect, the powered indicator comprises a light. For example, the light may comprise an LED strip.

In another aspect, the light is mounted to the deck for providing illumination of at least a portion of the deck. Alternately, the light may be mounted to the lift mechanism.

In yet another embodiment, a stair chair includes a base, which has a head end, a foot end, and a plurality of casters, a deck for supporting a patient, a lift mechanism supporting the deck on the base, and a wheel mounted to the base at the head end or a track mounted to the base to enhance handling of the stair chair.

In one aspect, the wheel and the track are mounted to the base.

In another aspect, the stair chair further includes a powered drive train for powering the wheel or the track.

In yet another aspect, the wheel is adapted to be releasably mounted to the base without disassembly.

In yet another aspects, the lift mechanism comprises an X-frame lift mechanism. For example, the X-frame lift mechanism may include first and second pairs of X-frames, each of the pairs of X-frames having upper ends and lower ends, with the upper ends of the first pair of X-frames pivotally coupled to respective lower ends of the second pair of X-frames. Further, the deck includes a seat section and an articulatable foot section, and wherein the X-frame lift mechanism remains in a footprint defined by the seat section when the X-frame lift mechanism is fully collapsed to its lowest position with clearance for the articulatable foot section to move to a seated position.

According to yet another embodiment, a patient support system includes a base for forming a part of a patient support, a litter deck for supporting a patient, the deck having a seat section and an articulatable foot section and removably mounted to the base to thereby form a support surface for the patient support, and with the litter deck being adapted to be supported by the base while being removed from the base until at least a portion of the litter deck is at least partially supported by the ground or another base.

For example, the base may comprise a first base, with the patient support comprising a first patient support. The patient support further comprises a second base of a second patient support, with the litter deck releasably mounted with respective to the first base and transferable to the second base and configured to be releasably mounted with respective to the second base to thereby form a support surface for the second patient support.

In one aspect, the first base comprises a lift mechanism for moving the litter deck relative to the first base when mounted with respective to the first base. For example, the lift mechanism comprises an X-frame lift mechanism and optionally with telescoping legs.

In another aspect, the second patient support comprises a stair chair. In yet another aspect, the first patient support comprises a cot, and optionally a cot reconfigurable between a chair and a cot.

In other aspects, the second base includes a track. For example, the track may be a removable track.

According to yet another embodiment, an emergency medical cot includes a base, a deck for supporting a patient, the deck being releasably mounted at the cot and being removable without disassembly, and a lift mechanism supporting the deck on the base, the lift mechanism configured to adjust the angular orientation of the deck.

In one aspect, the deck includes a seat section, a head section articulatable relative to the seat section, and a foot section articulatable relative to the seat section.

In other aspects, the lift mechanism is configured to adjust the angular orientation of the deck while allowing the head section and the foot section to be articulated relative to the seat section. For example, the lift mechanism comprises an X-frame lift mechanism. Further, the lift mechanism may have telescoping legs.

According to yet another embodiment, a patient support system includes a first base for forming a part of a first patient support, a litter deck including a track, a second base for forming a part of a second patient support, the litter deck mounted to the second base and for supporting a patient thereon, and the litter deck being configurable in chair configuration, and with the second base and the deck being reconfigurable to lie in a generally horizontal configuration and adapted to be mounted to the first base to thereby form a patient support surface for the first patient support.

In one aspect, the first base comprises a lift mechanism for moving the litter deck relative to the first base. For example, the lift mechanism may comprise first and second pairs of X-frames, each of the pairs of X-frames having upper ends and lower ends, with the upper ends of the first pair of X-frames pivotally coupled to respective lower ends of the second pair of X-frames. Optionally, each of the first and second pairs of X-frames having telescoping legs wherein the lift mechanism can tilt the litter deck with respect to the first base when the litter deck is mounted to the first base.

In one aspect, the litter deck has a seat section and articulatable head and foot sections. In other aspects, the second patient support may comprise a stair chair. And, the first patient support may comprise a cot.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENTS

Figure 1:
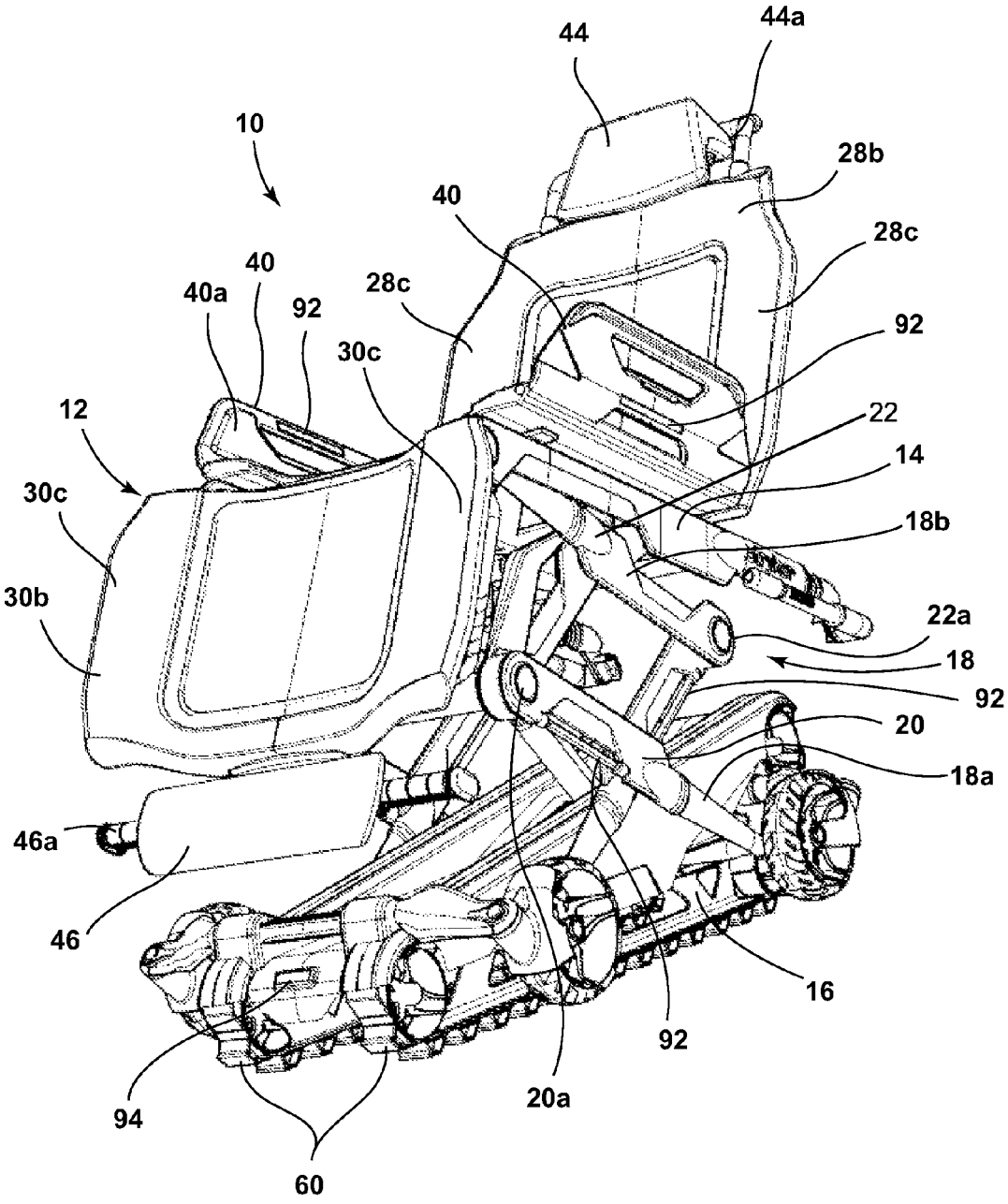
FIG. 1 is a perspective view of a patient support of the present invention shown in a chair configuration.
Figure 2:
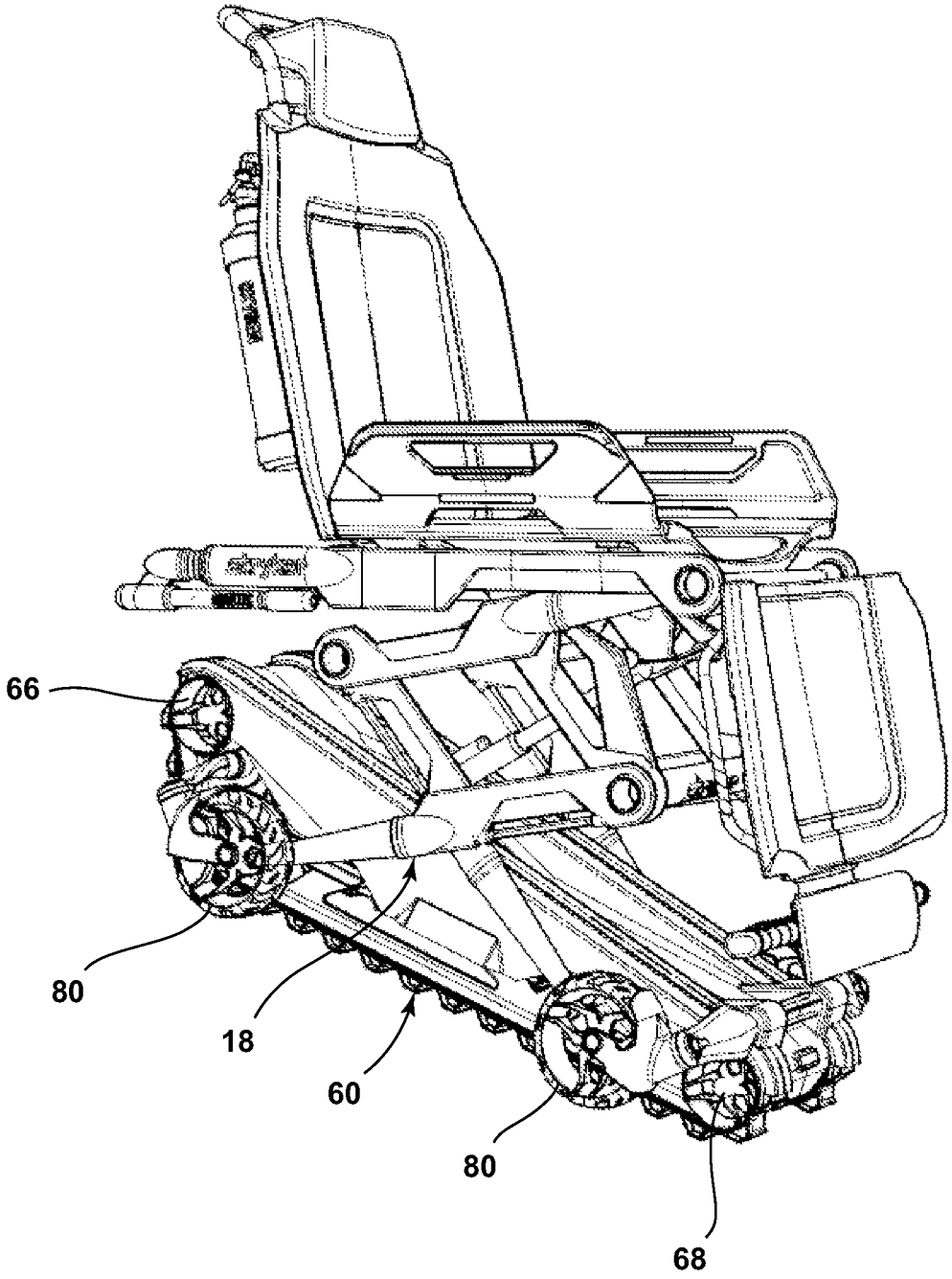
FIG. 2 is another perspective view of the patient support of FIG. 1.
Figure 13:
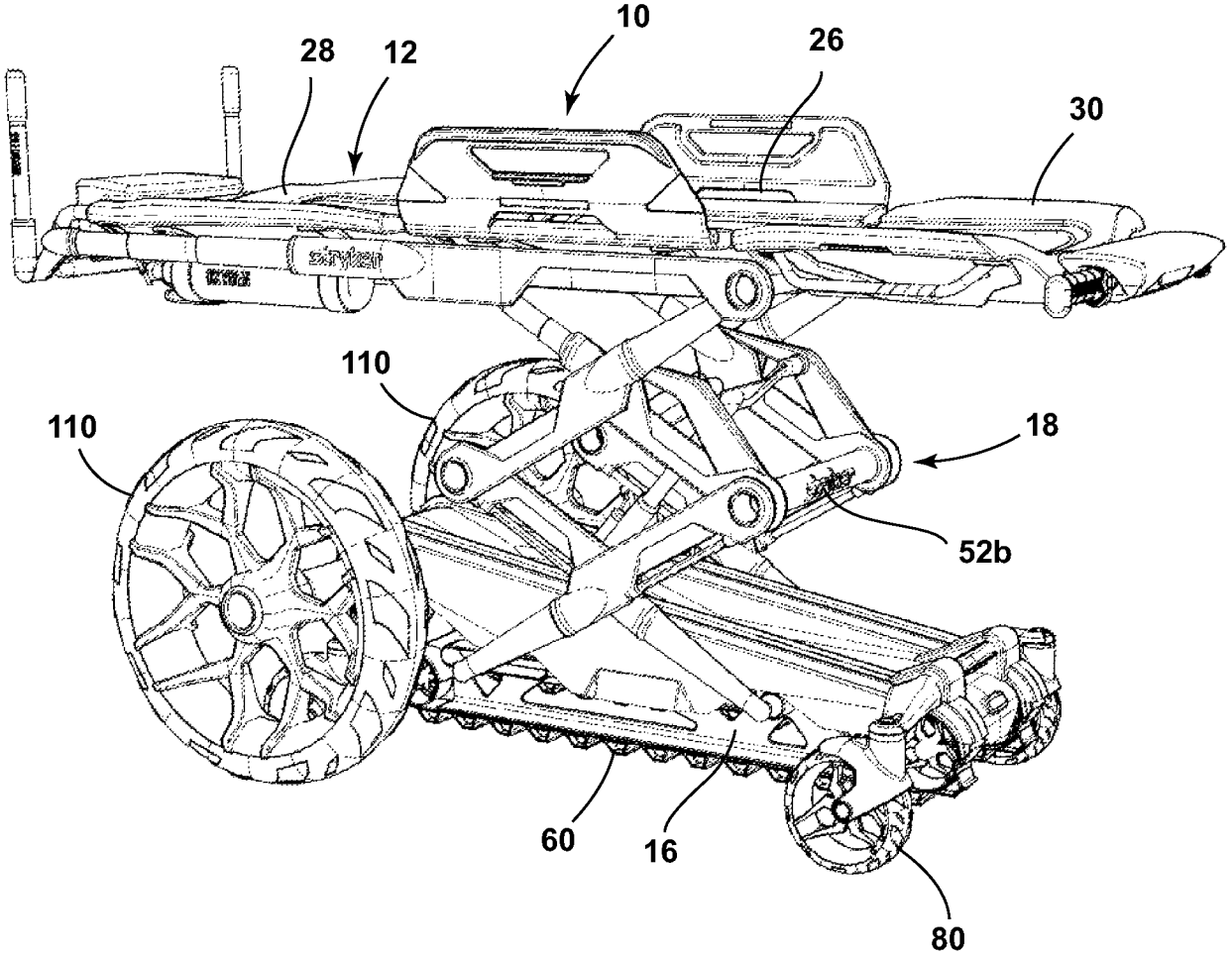
FIG. 13 is a similar view of FIG. 12 with the axillary wheels mounted to the patient support.
Figure 14:
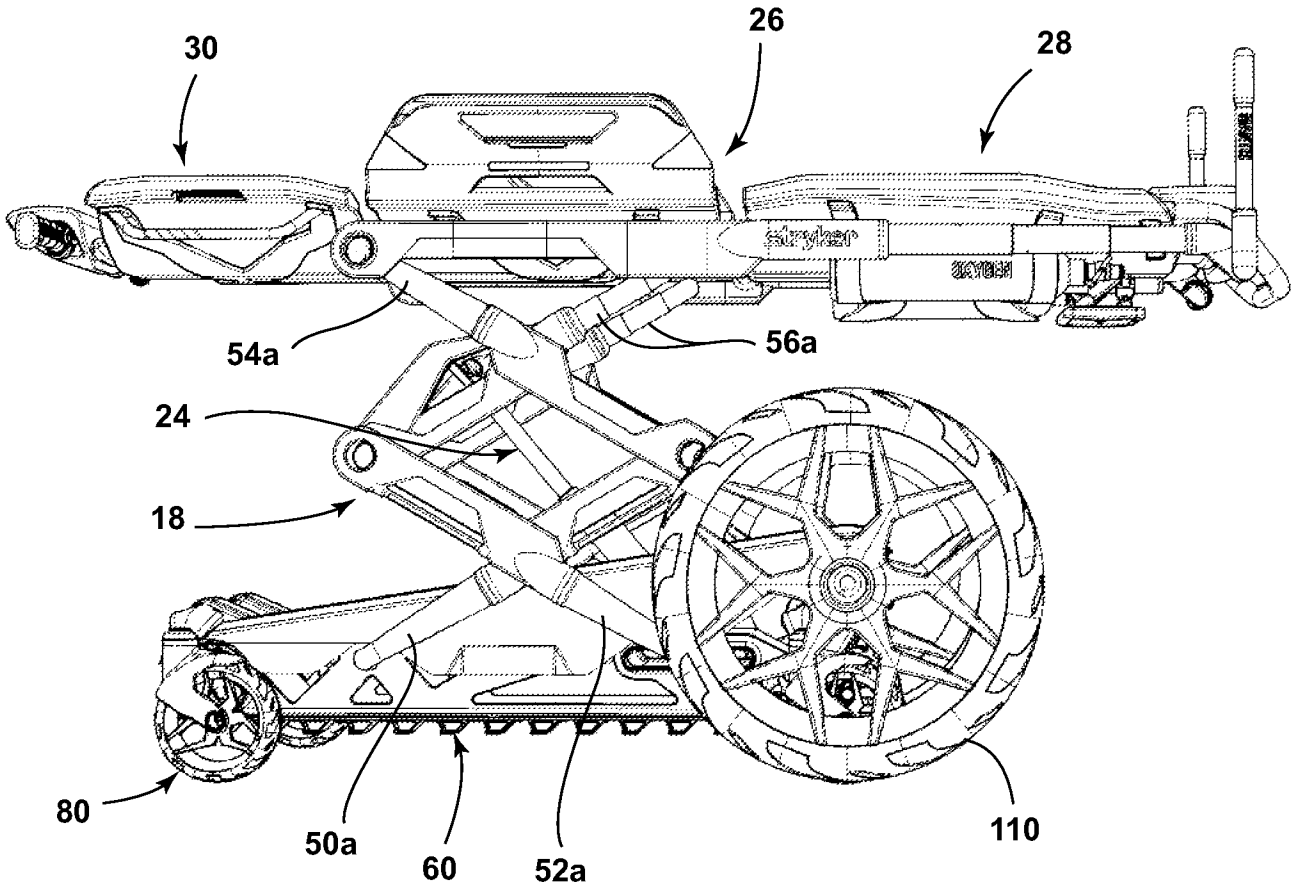
FIG. 14 is a side elevation of the patient support with the axillary wheels mounted.
Figure 15:
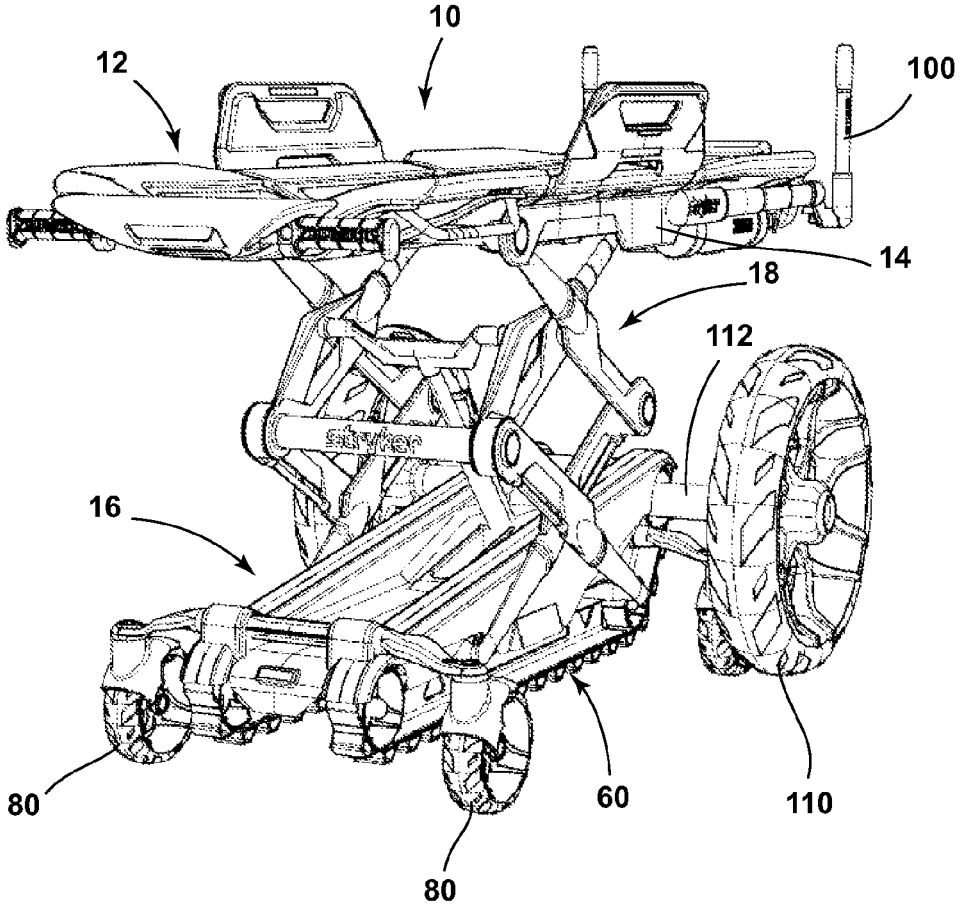
FIG. 15 is a perspective view of the patient support in the cot configuration with the axillary wheels mounted.

Referring to FIG. 1, the numeral 10 generally designates a patient support of the present invention. As will be more fully described below, patient support 10 may include an articulatable deck to allow the patient support to be configured between a chair configuration, such as shown in FIG. 1, and cot configuration, such as shown in FIG. 13. Further, the patient support optionally includes a lift mechanism that has a compact configuration, which can provide a great range of motion and further may tilt the deck section to provide a more comfortable sitting arrangement for a patient supported on the patient support when the patient support is a chair configuration. Further, the patient support may incorporate a track assembly and/or a large axillary wheel in addition to its casters to optionally provide a powered patient support and, further, one that offers greater maneuverability.

Referring again to FIG. 1, patient support 10 includes a deck 12, which is supported on a frame 14 and a base 16, which supports frame 14 and deck 12 by way of a lift mechanism 18. Optionally, deck 12 may be removable, such as described below in reference to support 210.

In the illustrated embodiment, lift mechanism 18 comprises a double X-frame lift mechanism with a pair of lower X-frames 18*a* and a pair of upper X-frames 18*b*, which are joined at their respective upper and lower ends by pivot connections 20*a* and 22*a*. The lower ends of lower X-frame members 18*a* are pivotally joined to base 16 with one of the lower ends being slidably, pivotally mounted to the base and the other pinned to the base. Similarly, the upper X-frame members are pivotally mounted to frame 14 with one upper end being slidably pivotally mounted and the other end pinned. In this manner, when the X-frames are pivoted about to their respective central pivot axes 20 and 22, frame 14, and hence deck 12, will be lowered or raised relative to base 16, as would be understood by those skilled in the art.

Figure 3:
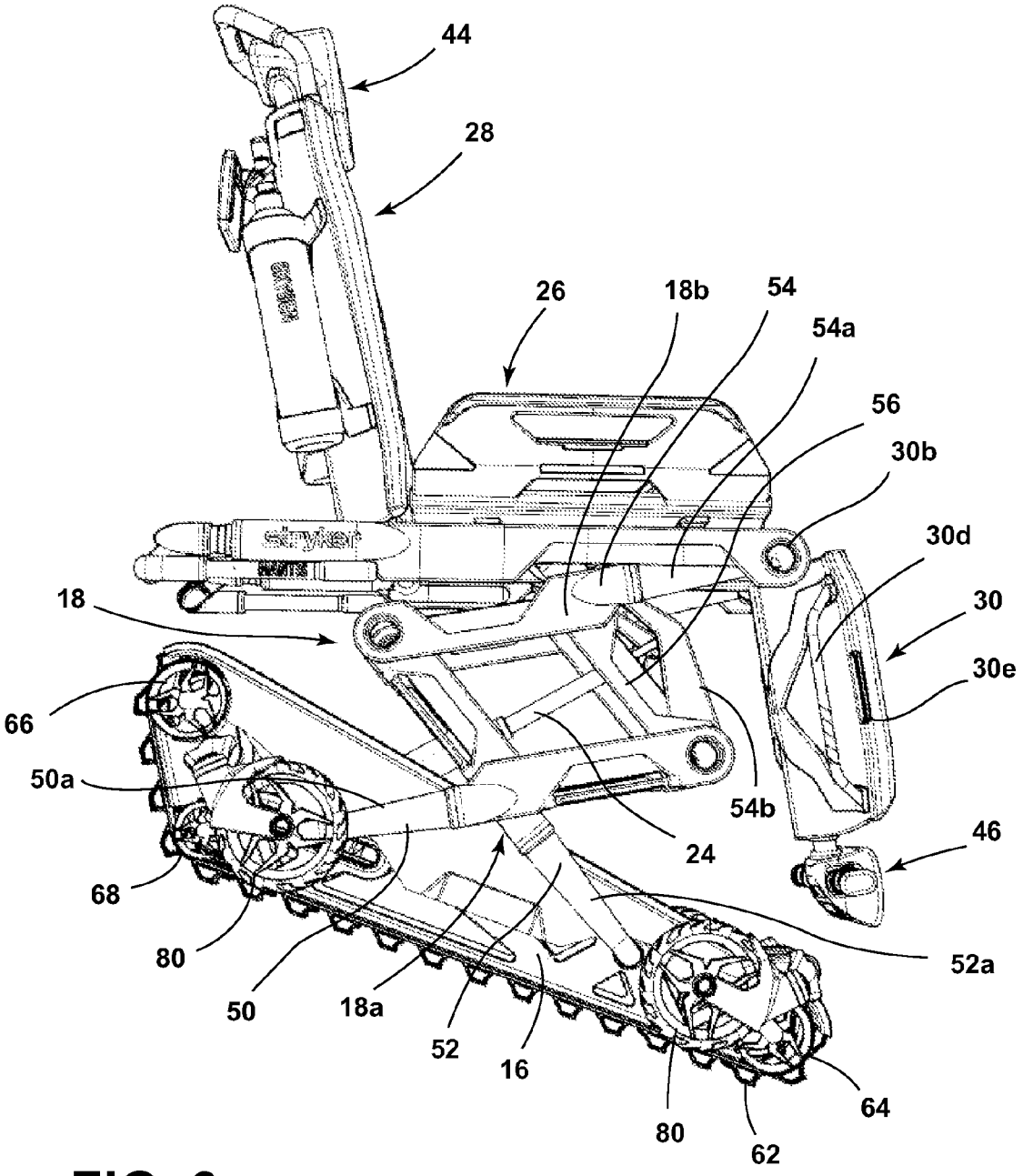
FIG. 3 is a side elevation view of the patient support of FIG. 1.

The unfolding and folding of the respective X-frames is provided by a driver 24, which is best illustrated in FIG. 3, for example, in the form of a cylinder, such as an electrically actuated cylinder, which is mounted on one end to base 16, for example, by way of a pivot connection, such as a bushing, and pivotally mounted by a bushing at its opposed end to a transverse rod 25, which is mounted between the arms of the upper X-frame members, as described below.

Figure 8:
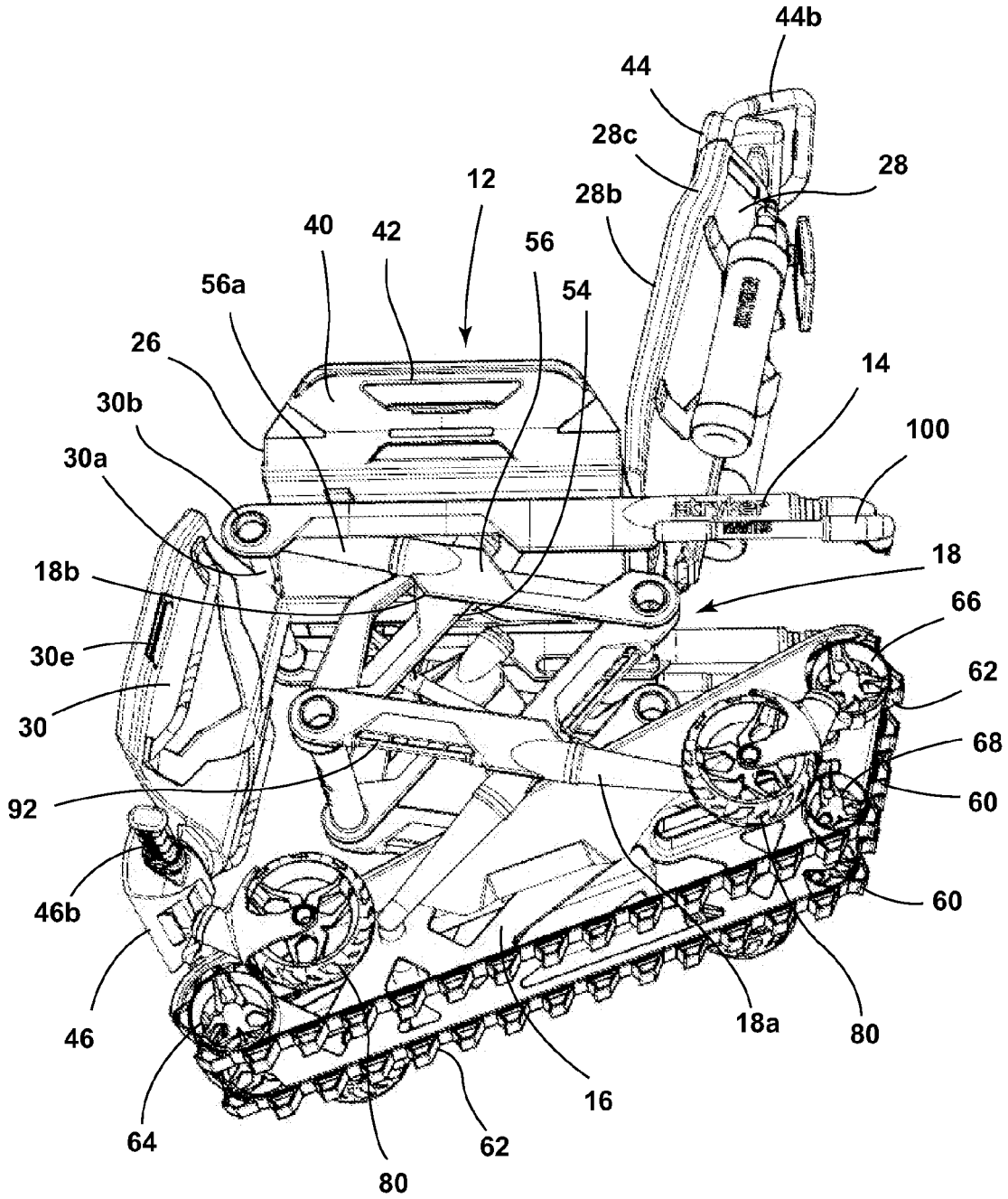
FIG. 8 is a bottom perspective view of the patient support of FIG. 1.

Referring to FIG. 8, deck 12 includes a seat section 26 and a head section 28 and a foot section 30, which are each articulatable relative to the seat section 26 (and independently articulatable relative to the seat section 26) and further with respect to lift mechanism 18. Each section may include a frame and a skin to support pads described below. Alternately, one or more of the seat section, head section, and foot section may comprise a perimeter frame and a pad supported by said frame, wherein the pad is exposed on both sides of the respective section. For example, the pad (or pads) may comprise a core cushioning member and a base supporting the cushioning member, with both the base and cushioning member enveloped in a cover, such as a liquid impermeable cover, such as vinyl. The base may be formed form a variety of materials that provide stiffness to the cushioning member. For example, the base may be solid or a mesh or a lattice and be formed from wood, metal, plastic, including plastic reinforced, for example with fibers or the like or a combination thereof. The base may also be formed from discrete members, such as strips or batons.

Foot section 30 may be pivotally mounted to frame 14 by way of a transverse shaft 30*a*, which is received in bushings 30*b* mounted to frame 14 and secured to the framework of section 30. The head section 28 may be pivotally mounted to the seat section 26 by a pivot shaft or the like, similarly mounted to the head section frame work. The articulatable sections of deck 12 may be manually moved or may be moved by actuators, such as electric actuators. When manually moved, the respective mounts may provide resistance or may incorporate a release mechanism, for example, which are released by handles or the like provided in the head section and/or foot section (such as a handle 30*e* of foot section 30 shown in FIG. 3).

Each respective section of the deck may include a pad to thereby form a sectioned support surface for a patient. The respective pads are sized and configured (and gatched) such that the deck sections may be moved between the chair configuration as shown in FIGS. 1-10, and further the cot configuration such as shown in FIGS. 13-16 without running interference with the adjacent pad or pads. Additionally, the padded sections 28*b* and 30*b*, may include laterally extending lips 28*c* and 30*c*, respectively, which optionally extend beyond the supporting framework of the deck to reduce the gap between the deck and an adjacent support surface, for example, when the deck is in its cot configuration to facilitate a patient transfer from the cot, so that the lip or lips at least partially fill the space to the adjacent surface to which the patient is being transferred.

Seat section 26 optionally includes side rails 40 that are pivotally mounted about the opposed sides of seat section 26 to frame 14. Side rails 40 may each include a hand hold 42, and further may be provided with a pad 40*a* to provide cushioned lateral support to a patient supported on support 10.

Side rails 40 are mounted in a generally vertical orientation relative to seat section 26 and may further be released from their generally vertical orientation to an angle relative to the support surface to increase the width of the deck, at least of the seat section of the deck. For example, side rails 40 may be configured to be tilted in a range from a generally vertical orientation, such as about 80-90 degrees relative to the patient deck at seat section 26 to an angle in a range from about 30-50 degrees relative to the seat section, and optionally no more than 45 degrees to avoid creating any instability issues.

In addition to seat sections and head sections, deck 12 may also incorporate extendible head and foot rests 44, 46 which may be mounted on telescoping tubes to thereby extend the length of the deck to accommodate taller patients. Telescoping tubes 44*a* and 46*a* may be moved manually, for example, by way of handles 44*b* and 46*b*. For example, the telescoping tubes 44*a* and 46*a* may provide resistance to movement of the respective head rest and foot rest (and provide infinite positioning between a fully extended position and retracted position) or may include detent mechanisms to provide defined positions for the respective rests. Alternately, the rests may be moved by actuators, such as electrically powered actuators.

Referring again to FIGS. 3 and 4, X-frames 18*a*, 18*b* of lift mechanism 18 are formed by pivotally joined arms 50 and 52, and 54 and 56, respectively. Each arm 50, 52, 54, and 56 may include a telescoping arm 50*a*, 52*a*, 54*a*, and 56*a*, respectively. The telescoping arm sections of X-frames 18*a* may be pivotally mounted to base 16, with the telescoping arms 54*a*, 56*a* being pivotally mounted to frame 14. Therefore, in addition to folding about the respective pivot axes, the respective arms of the X-frames can be extended or contracted to thereby tilt deck 12, such as shown in FIGS. 2-4, and 7. In this manner, when a patient is supported on the deck 12, and patient support 10 is in its stair chair configuration, such as shown in FIGS. 1-10, a patient may be tilted relative to the lift mechanism and therefore relative to the base at an angle that is more comfortable for patient, for example in a range of 0 (zero) degrees plus or minus about 40 degrees from horizontal. Further, lifting mechanism 18 may tilt deck 12 when in its cot configuration to tilt the deck into a Trendelenberg or reverse Trendelenberg configuration.

Figure 4:
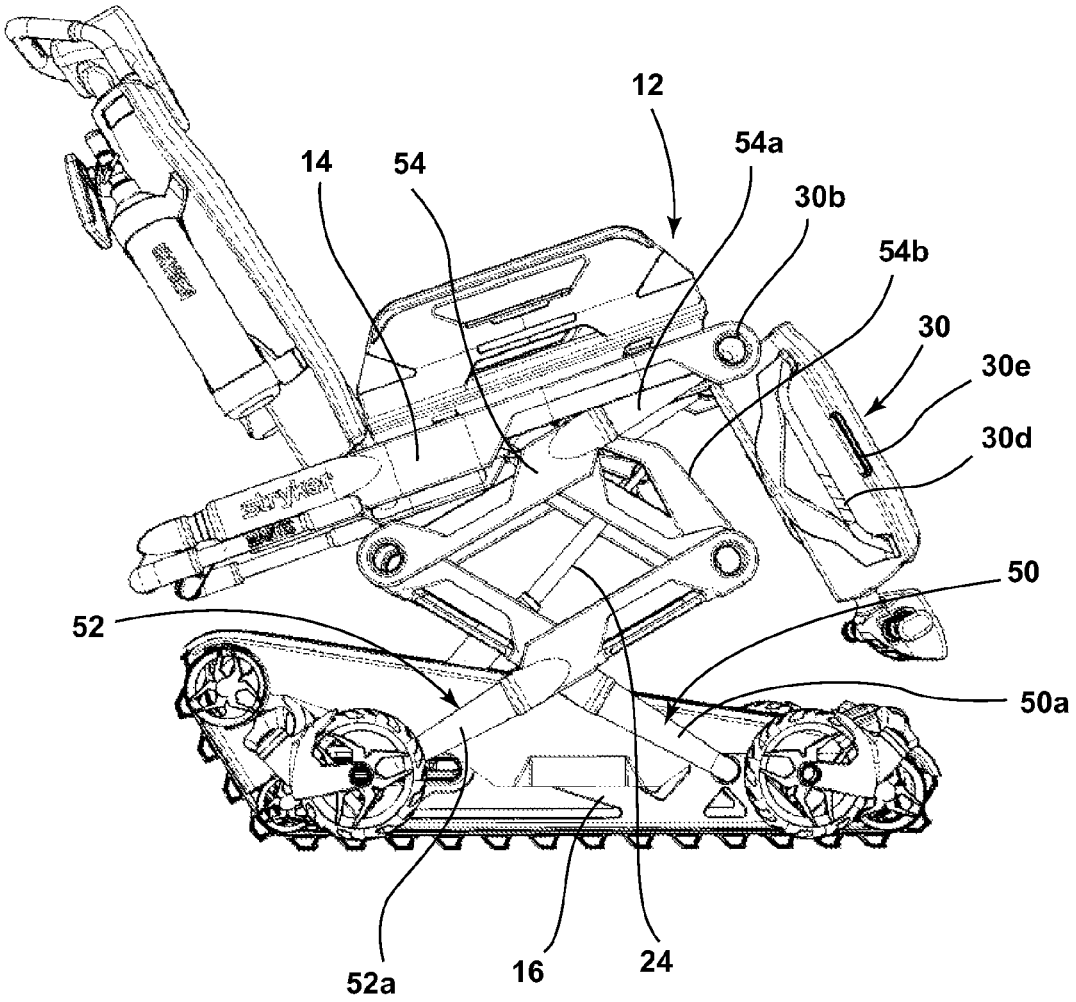
FIG. 4 is another side elevation view of the patient support of FIG. 1.
Figure 9:
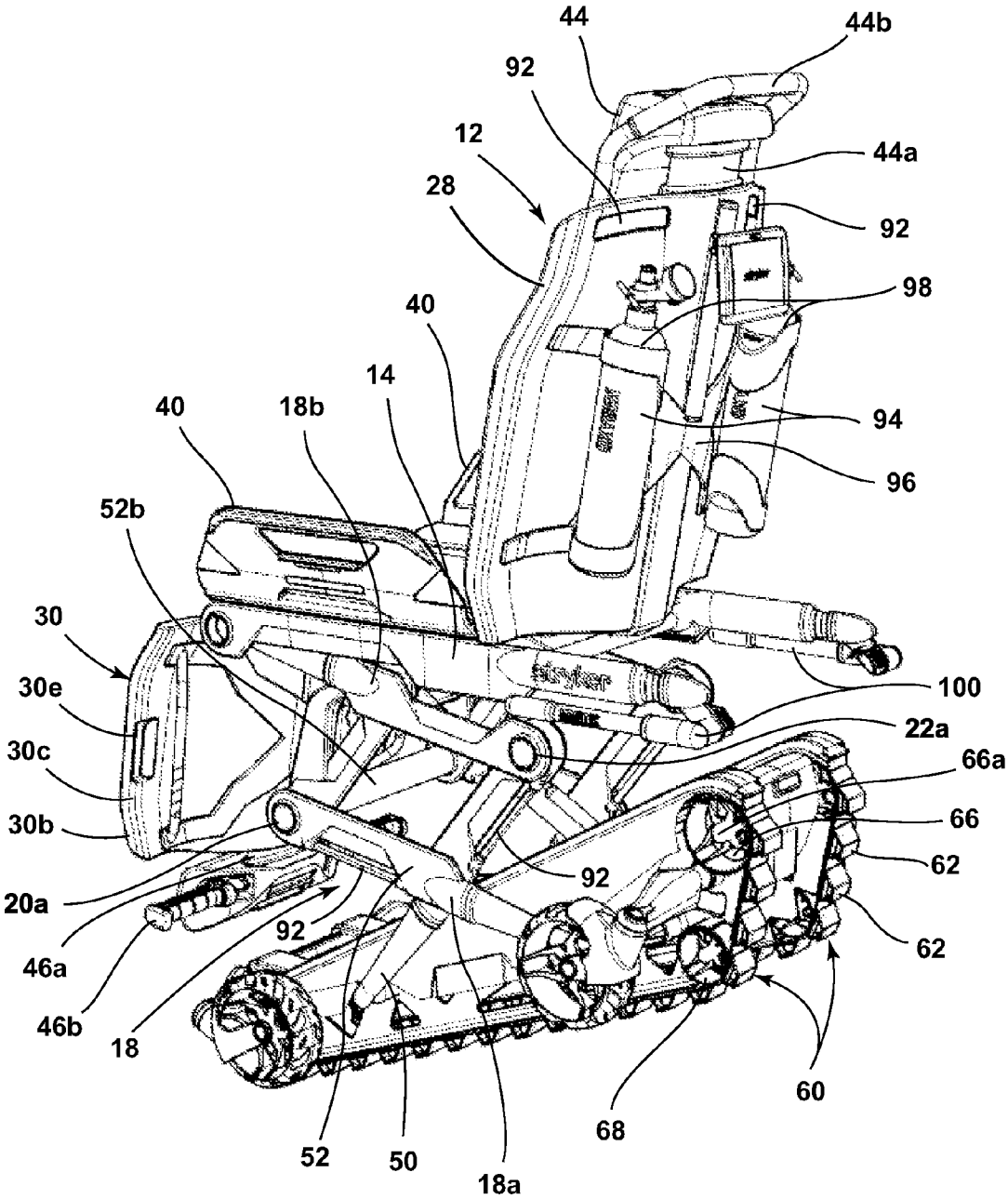
FIG. 9 is a rear perspective view of the patient support of FIG. 1.

As best seen in FIGS. 1, 8 and 9, arms 50 may be joined together by a transverse member, such as a transverse rod 52*a*. Similar, arms 54 may be joined by transverse rod 25 (FIG. 10) by way of offsetting arms 54*b* (FIG. 4). With this configuration, the lift mechanism may have a compact configuration, which can provide a greater range of motion and further may allow the deck to be lowered to a low height of less than 14, less than 13" and as low as 12".

As previously noted, patient support 10 may be configured as a chair, and more particularly as a stair chair. In the illustrated embodiments, base 16 includes a track assembly 60. Track assembly 60 may be formed from a pair of continuous loops of treaded belt to form a pair of moving tracks 62, which are mounted about wheels 64, 66, and 68 to form generally triangular shaped pathways for the belts. A suitable belt has an inner drive tread and an outer drive tread. Wheels 64, 66, and 68 may be mounted directly to base 16 or may be mounted to a separate frame, which can then be mounted to base 16, which allows the whole track assembly to be removable.

Figure 10:
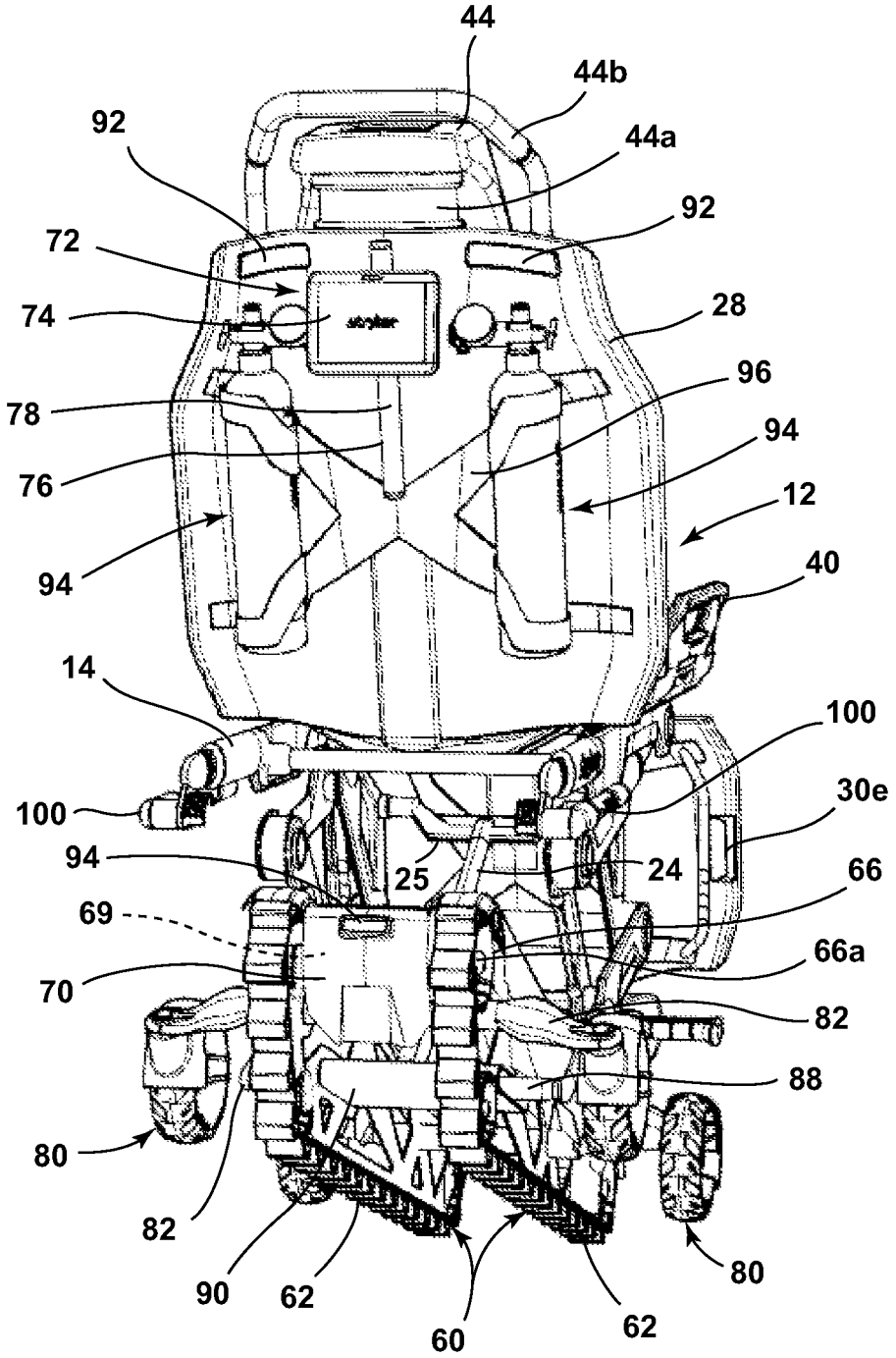
FIG. 10 is a rear perspective view of the patient support of FIG. 1.

As noted above, track assembly 60 may be powered. For example, as best seen in FIGS. 9 and 10, wheel 66 may be mounted about a drive axle 66*a*, which is driven by a motor 69 housed in base 16. For example, motor 69 may be housed in housing 70, which may also include a power supply for driving the motor, such as a battery, including a rechargeable battery. Optionally, foot end wheels 64 of track assembly 60 may also be power driven, for example, by a motor positioned between wheels 64, which drives a drive shaft supporting wheel 64.

Actuator 24 and motor 69 (or motors) may be controlled by controls mounted to support 10 including, for example, a wireless motor control provided for example by a user interface 72. In the illustrated embodiment user interface 72 comprises a touch screen 74. User interface 72 may be incorporated into support 10, for example, at the head section, or may be removably mounted such as shown in FIG. 10, as well as to various hand holds or handles provided around support more fully described below. For example, head deck section 28 may support a mounting structure 76, such as a rail 78, which allows user interface 72 to be removably mounted to head section of deck 12. Further, when in the form of a rail, the position of the user interface may be adjusted. For example, a suitable mounting mechanism may comprise a clamp with an optional release mechanism to allow the position of the user interface to be adjusted. Therefore, an attendant standing behind the raised head section of support 10 may operate motor 69 by simply touching touch screen 74, which may provide multiple functions by way of multiple touch screen areas, all controlled by a graphic user interface (GUI). For example, user interface 72 may have an application that generates designated touch screen areas that form a menu, with user input areas, and further which may generate displays or icons representative of the function being controlled. Further, user interface 72 may be configured as a monitor to display images or movies to show the patient or the caregiver. Optionally, user interface 72 may incorporate a camera, microphone and/or speaker. For example a suitable interface may comprise a tablet, such as an iPad available from Apple, with applications that provide these and other features. In addition to controlling motor 69, user interface 72 may also control lighting provided about support 10, described more fully below. Alternately, the lighting may be controlled by onboard circuitry and sensors, such as light sensors that detect the ambient lighting conditions and actuate the lights to provide better visibility of support 10 (also as described below).

Referring to FIGS. 1-10, support 10 also may incorporate a plurality of caster wheels 80 to allow support 10 to be maneuvered independently of track assembly 60. For example, suitable caster wheels are available from Tente. Caster wheels 80 may be mounted by articulating arms 82, which allow the caster wheels to be moved from ground engaging positions to non-ground engaging positions where the bottom surface of the respective caster wheel is above the bottom surface of the tracks 62, such as shown in FIG. 3.

Figure 5:
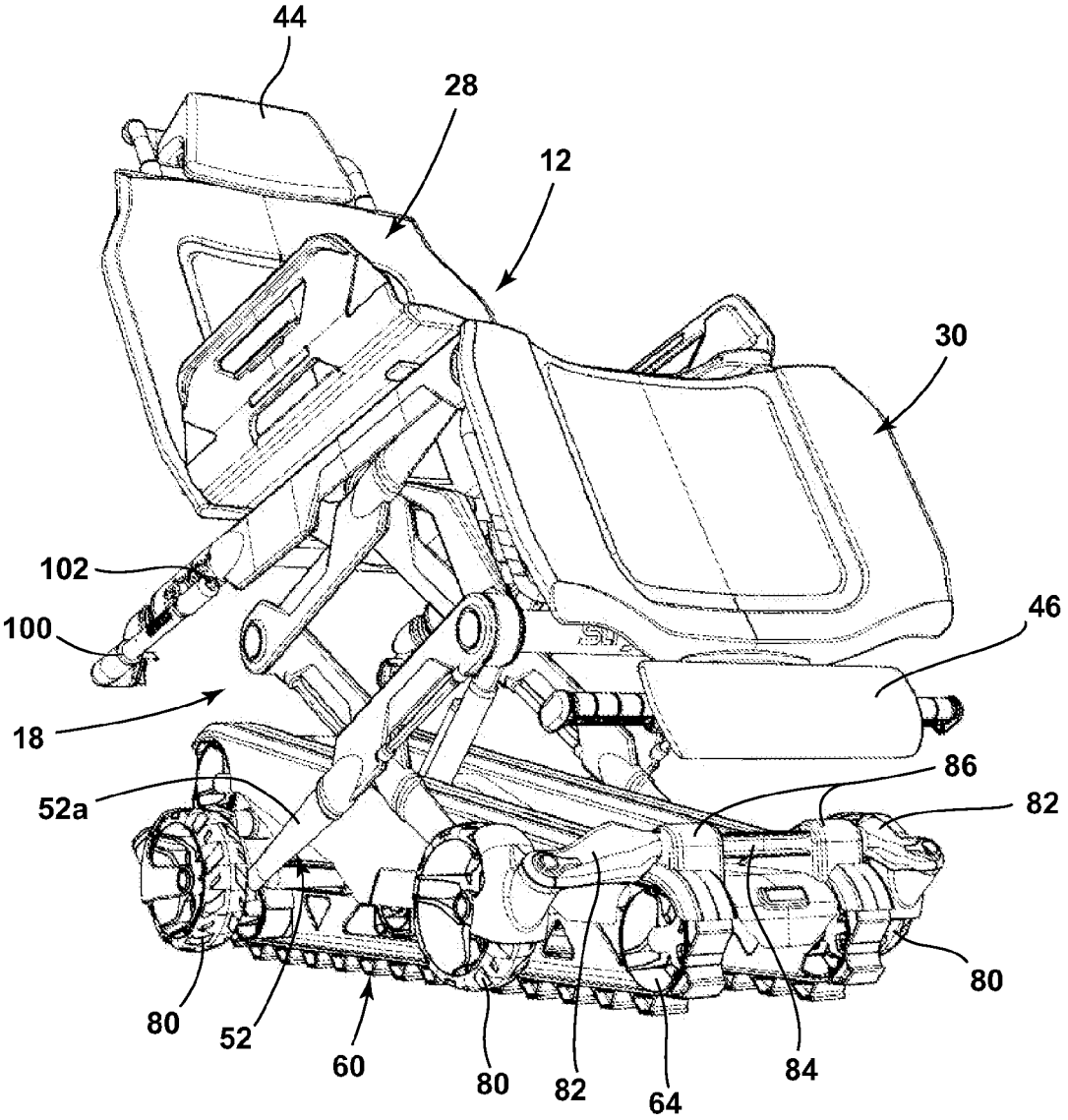
FIG. 5 is another perspective view of the patient support of FIG. 1.
Figure 6:
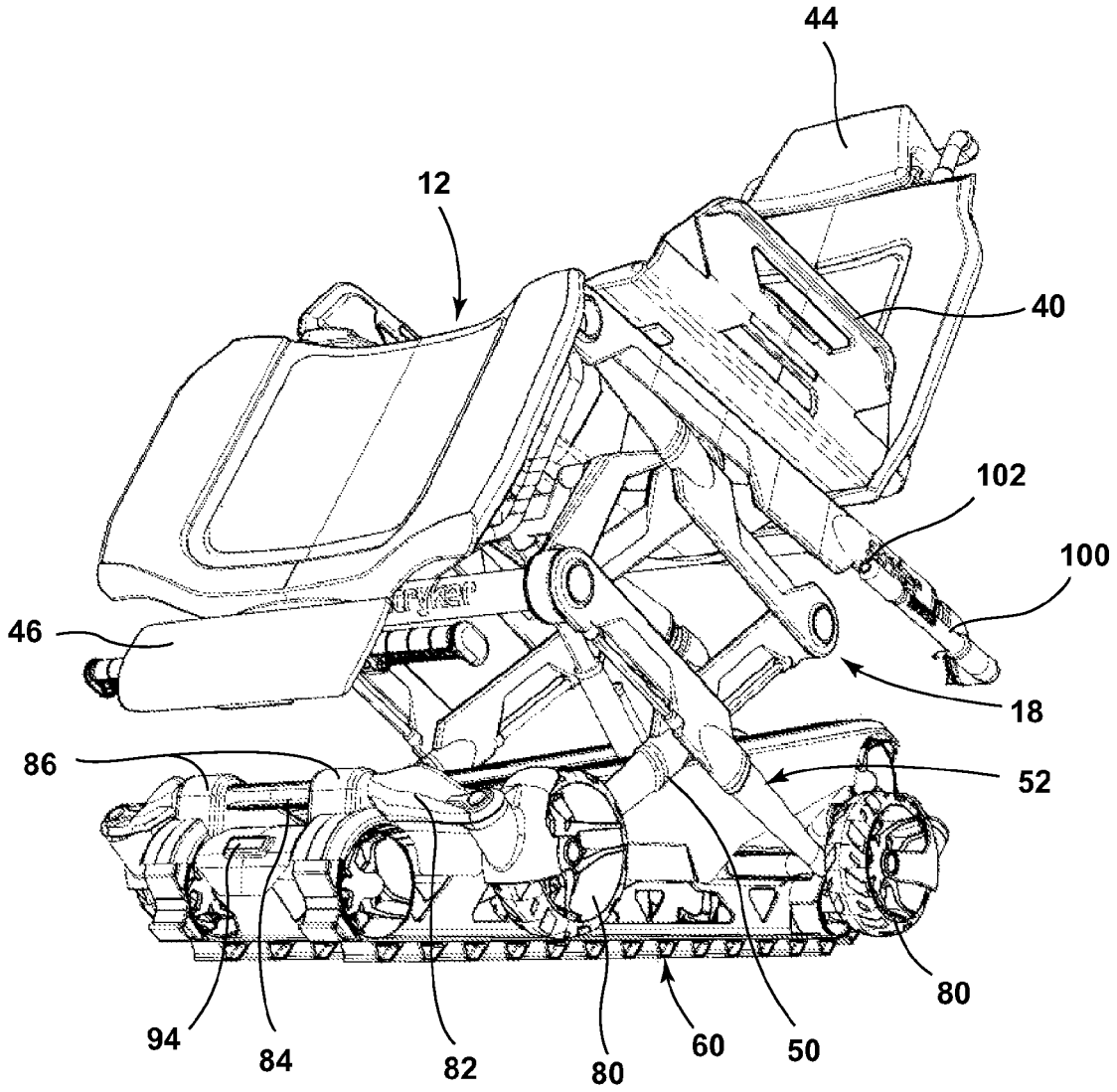
FIG. 6 is yet another perspective view of the patient support of FIG. 1.
Figure 7:
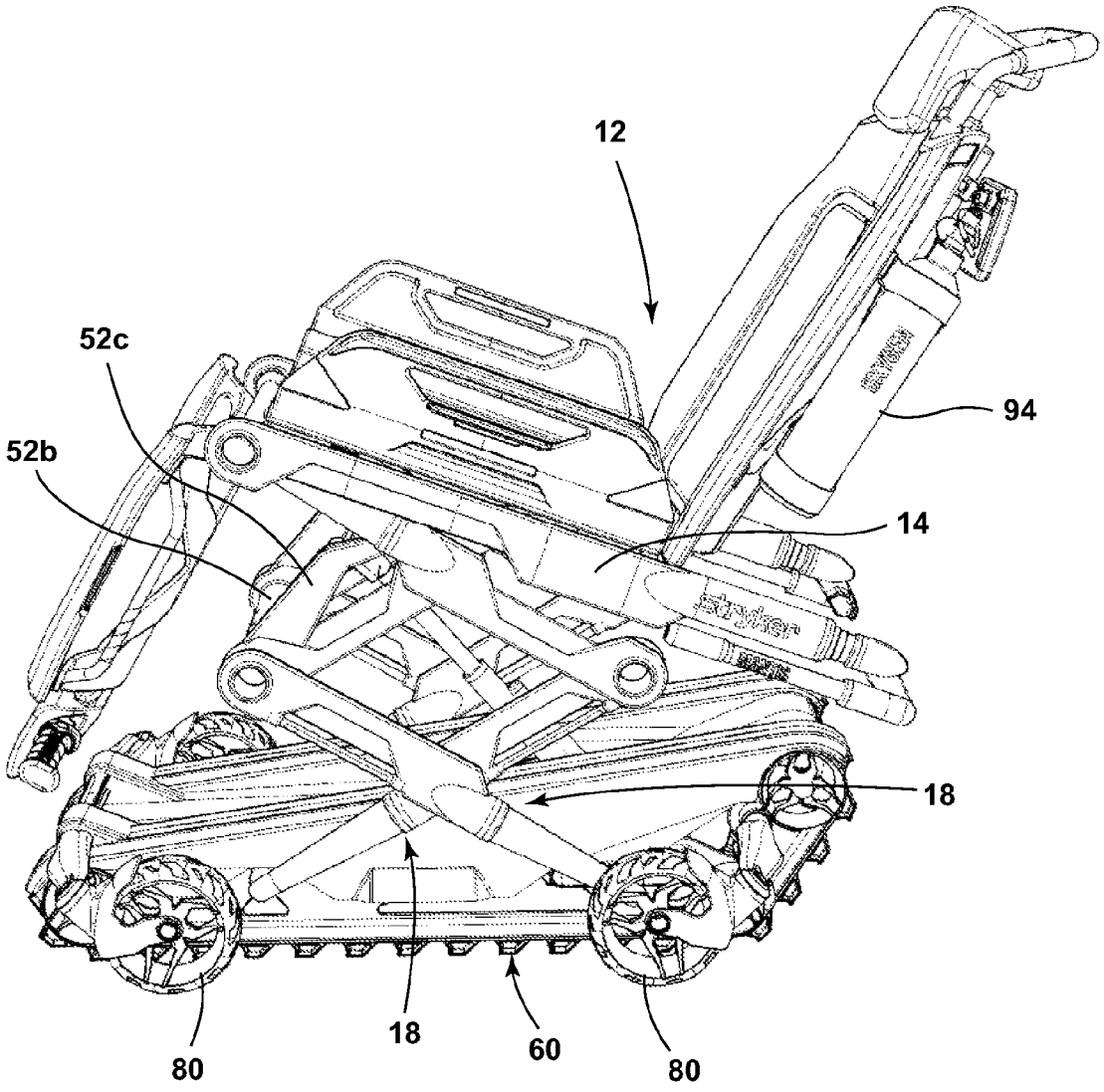
FIG. 7 is another side elevation view of the patient support of FIG. 1.

As best seen in FIGS. 5 and 10, articulating arms 82 of the foot end caster wheels may be mounted to rotatable shafts 84 supported by supports 86, which optionally include a resistive mechanism which resists the movement of the shaft and hence respective caster wheels but allows the caster wheels to be manually moved only when sufficient force is applied to the casters. For example, foot end caster wheels 80 may be mounted to an axle 84, rotatable mounted in supports 86 by bushings and further with a torsional spring, which provides resistant to rotation of shaft over certain ranges of motion but little or no resistance over other ranges of motion to define two defined positions with high resistance, such as the ground engaging position and the non-ground engaging position. For an example of a suitable shaft and spring reference is made to co-pending U.S. patent application Ser. No. 13/783,699, entitled PATIENT SUPPORT, filed on Mar. 4, 2013, which is which is incorporated by reference herein in its entirety and commonly owned by Stryker Corporation of Kalamazoo, Mich.

As best seen in FIG. 10, head end caster wheels 80 may be also mounted to an axle 88, which may be supported in transverse support 90. Support 90 may also be configured to provide resistance to the rotation of shaft 88 and further, optionally, with high resistance positions defining the ground and non-grounding engaging positions of the head end caster wheels.

As noted above, support 10 may incorporate a plurality of lights to provide various functions. For example, support 10 may include lights to provide lighting when the support is used in a low ambient light condition, to provide increased visibility of support 10, or simply to provide enhanced visibility for the emergency medical staff, for example, to indicate where the side rails are and further where the head section is so that the attendants can quickly locate and, when needed, maneuver sections of the support.

For example, referring to FIG. 1, the lighting may comprise light strips 92, for example LED light strips, mounted at side rails 40, in X-frame 18 for example in arms 50 and 52, as well as seat section 28, such as shown in FIG. 9. In this manner, the support and its several components are quickly visible to emergency medical personnel, even when in a low light condition. The support may include additional lighting, such as lighting strips 94 (FIG. 1 and FIG. 10), which may be provided to indicate the status of one or more components, such as the battery or batteries. For example, the light may indicate a fully charged battery status or a low charge battery status.

Referring again to FIGS. 9 and 10, head section 28 may be adapted to support a pair of oxygen bottles 94. For example, head section 28 of deck 12 may include a support 96 mounted to the framework of head section 28 at the back of the deck, which forms receptacles 98 for receiving respective oxygen bottles 94. The support may be removable and further may also support for rail 78 or may include rail 78.

Additional controls may be provided in handles 100, which are mounted to frame 14. For example, handles 100 may be pivotally mounted to frame 14 to allow handles 100 to be moved between operative positions where the handles may be pushed or pulled on to move patient support 10 or a stored position, such as shown in FIGS. 8-10. For example, handles 100 may support one or more switches, such as shown in FIG. 5 which may be used to also control motor 69. In this manner, switches 102 may be configured to override the status of the motor control provided by user interface 72. Similarly, user interface 72 may be configured to override switches 102. In addition, switches 102 may optionally comprise wireless switches to allow further wireless control of support 10. Handles 100 may also provide a mounting surface for user interface 72.

Referring now to FIGS. 13-16, as previously noted, deck 12 may be reconfigured such that seat section 26, head section 28, and foot section 30 lie in a generally common plane to thereby form a cot configuration for support 10. Further, as noted the deck may be positioned in a generally horizontal orientation, such as shown in FIG. 13 or may be tilted in a Trendelenberg or reverse Trendelenberg configuration. This may be achieved by the tilting of deck sections by way of lift mechanism 18.

Figure 11:
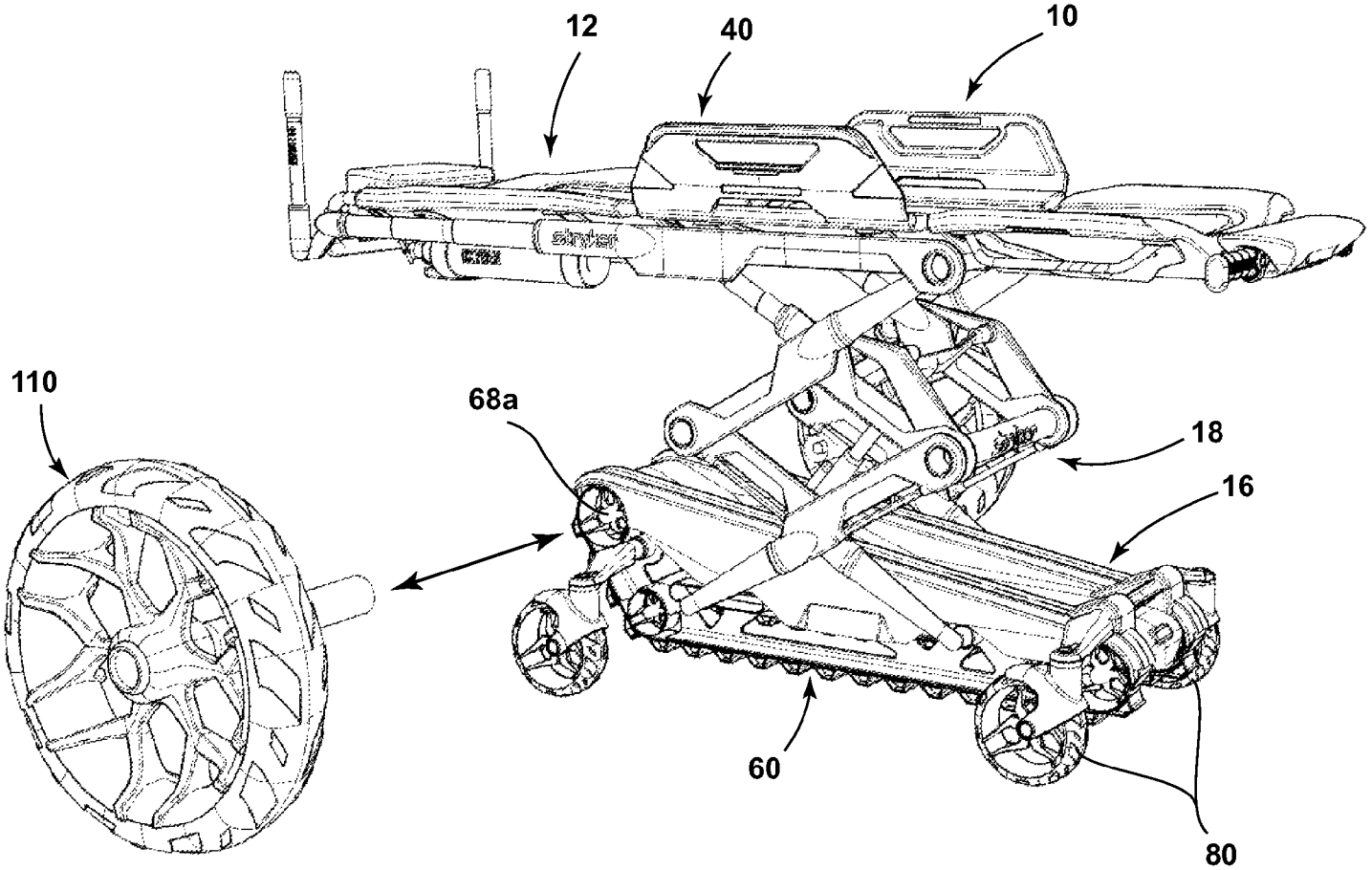
FIG. 11 is another perspective view of the patient support of FIG. 1 shown in a cot configuration.
Figure 12:
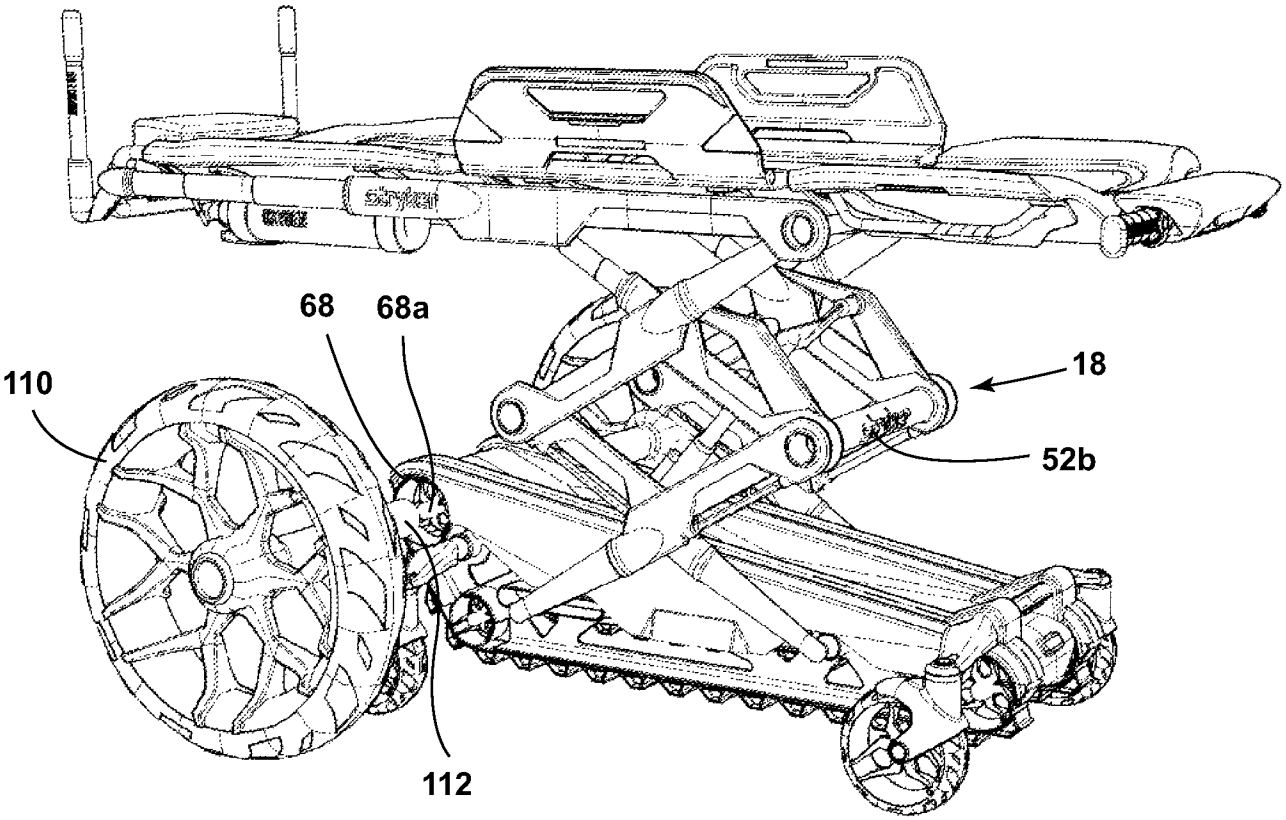
FIG. 12 is another perspective view of the patient support in the cot configuration illustrating the addition of wheels to the patient support.

To increase maneuverability of support 10, support 10 optionally includes auxiliary wheels 110, which may be mounted such as shown in FIGS. 11-12 to drive axle or drive socket 68*a* of wheels 68 by way of a stub shaft 112. In this particular configuration, handles 100 are particularly suitable for maneuvering support 10.

Figure 16:
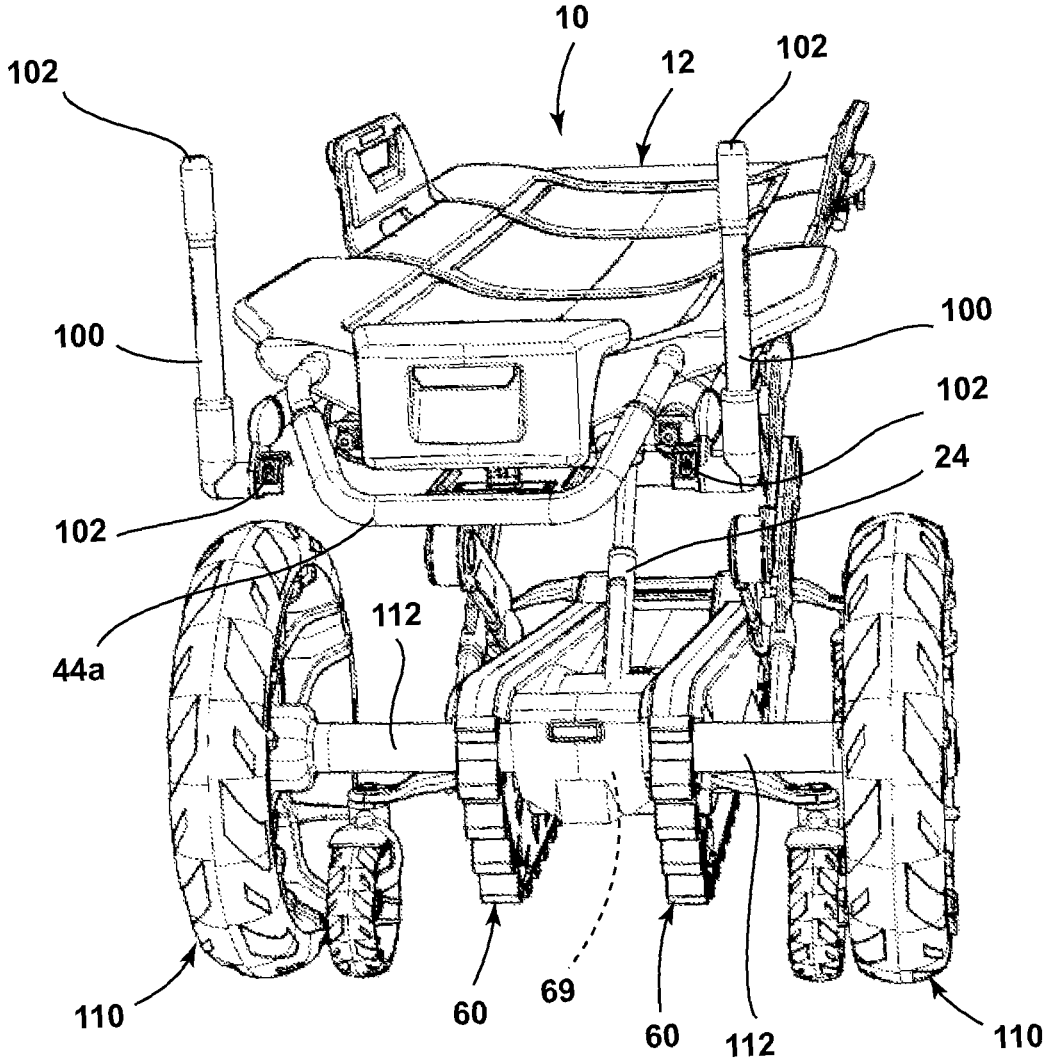
FIG. 16 is an end perspective elevation view of the patient support in the cot configuration.

Referring to FIG. 16, when arms 100 are moved to their generally vertical orientation, such as shown in FIG. 16, switches 102 may be alternately or in addition provided at the base or elbows of handles 100. Alternately, additional switches 102 may be provided adjacent the bases of elbows of handles 100, which provide control of the respective motors, actuators and other devices at support 10 in lieu of the user interface device, which may be generally inaccessible once the head section 28 is lowered generally to the cot configuration. However, it should be understood that the user interface may be removed from head section 28 and instead mounted to, for example, handle 100 or handle 44*a* to provide controls which are readily accessible to a person handling support 10 even when support is a cot configuration.

As would be understood, the patient support may include an articulatable deck to allow the patient support to be configured between a chair configuration and cot configuration and further optionally includes a lift mechanism, which is configured to tilt the deck with the deck is in its cot configuration. The chair may be configured as stair chair with tracks or may have the tracks removed and used as a trackless chair. The lift mechanism may have a compact configuration, which can provide a great range of motion and further may allow the deck to be lowered to a low height of less than 14, less than 13" and as low as 12". Further, the lift mechanism allows the deck to tilt even when in its chair configuration to provide a more comfortable sitting arrangement for a patient supported on the patient support. In addition, with the dual X-frame configuration the foot section can be lowered into a chair position even when said X-frames are in a lowered position. For example, the X-frames as shown may be configured to remain in a footprint defined by the seat section when the X-frames are fully collapsed to their lower most position to provide a compact mechanism while still retaining a full range of motion.

Further, the patient support may incorporate an auxiliary wheel, in addition to its casters, to offer greater maneuverability and stability and optionally to provide a powered patient support.

Figure 17:
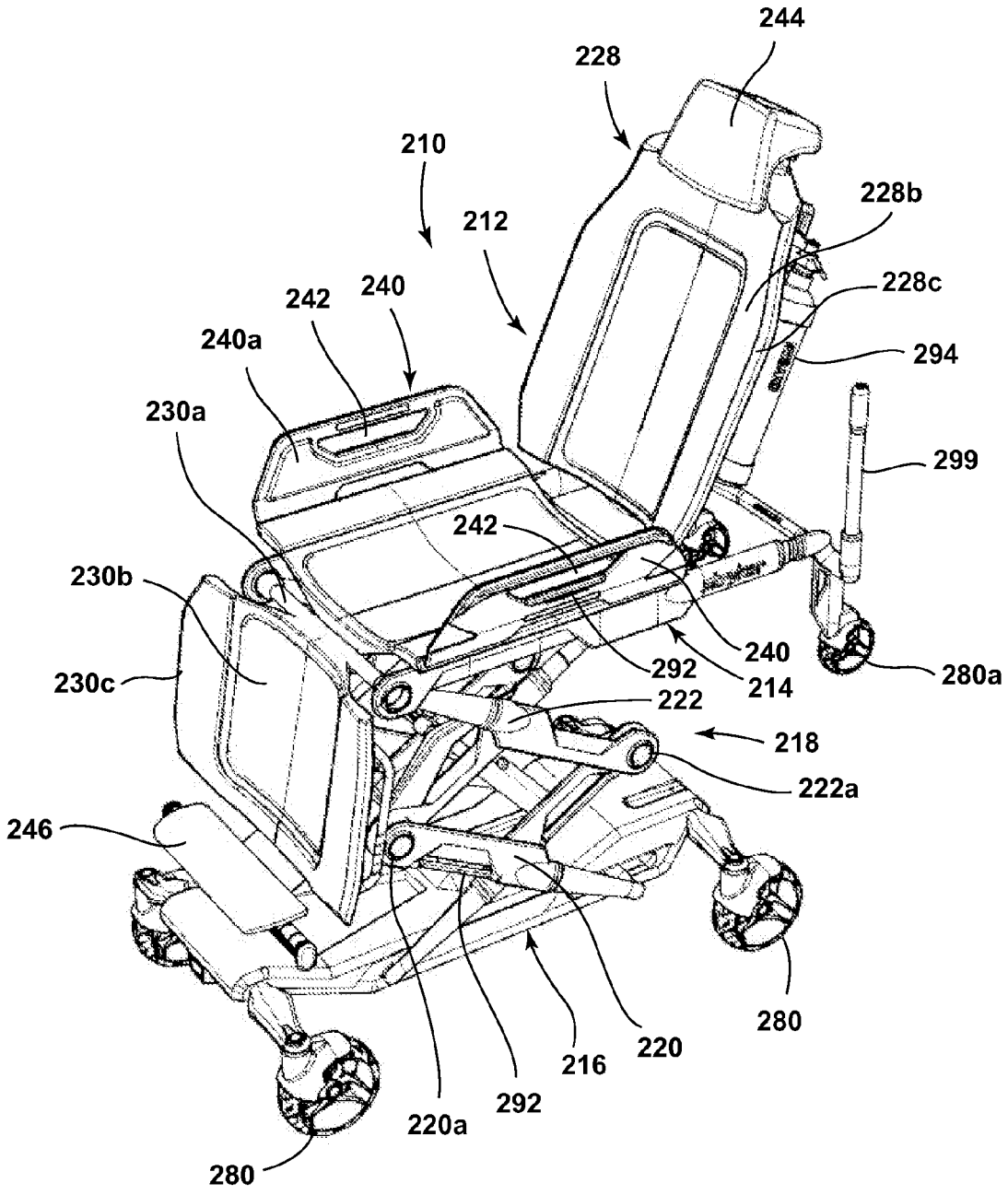
FIG. 17 is a perspective view of a patient support of the present invention in the form of a cot shown reconfigured in a chair configuration.
Figure 17A:
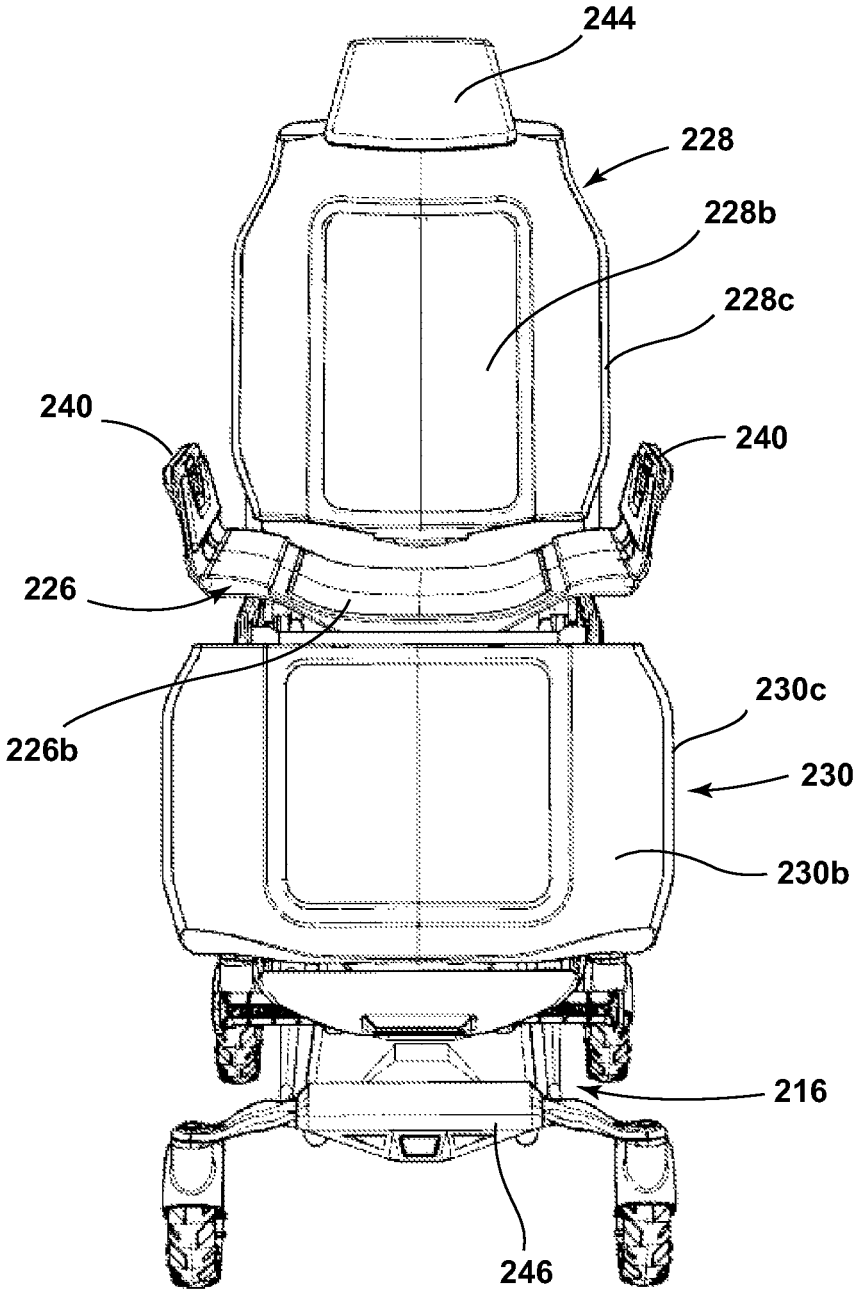
FIG. 17A is a front view of the patient support of FIG. 17.
Figure 18:
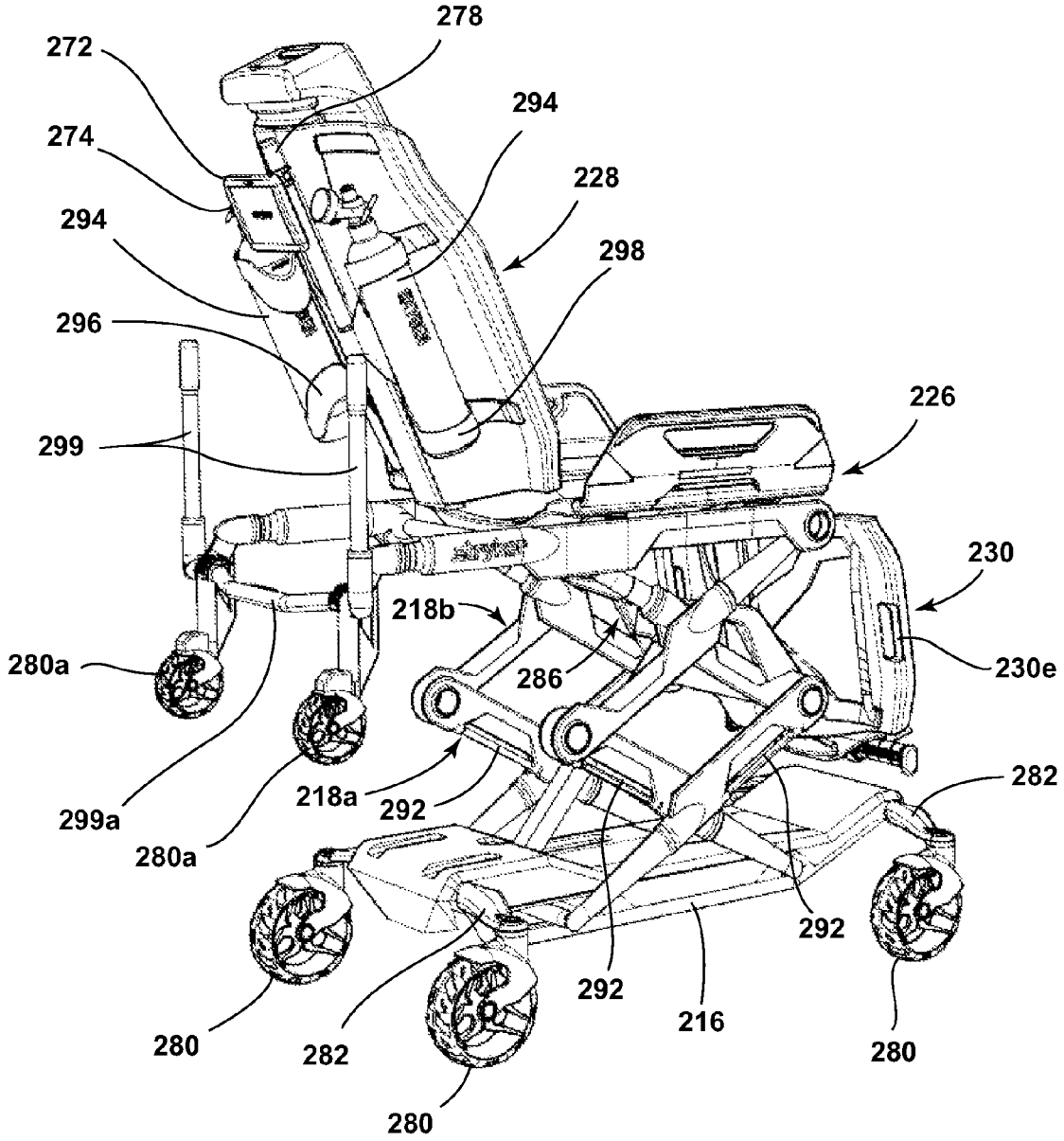
FIG. 18 is another perspective view of the patient support of FIG. 17.
Figure 23:
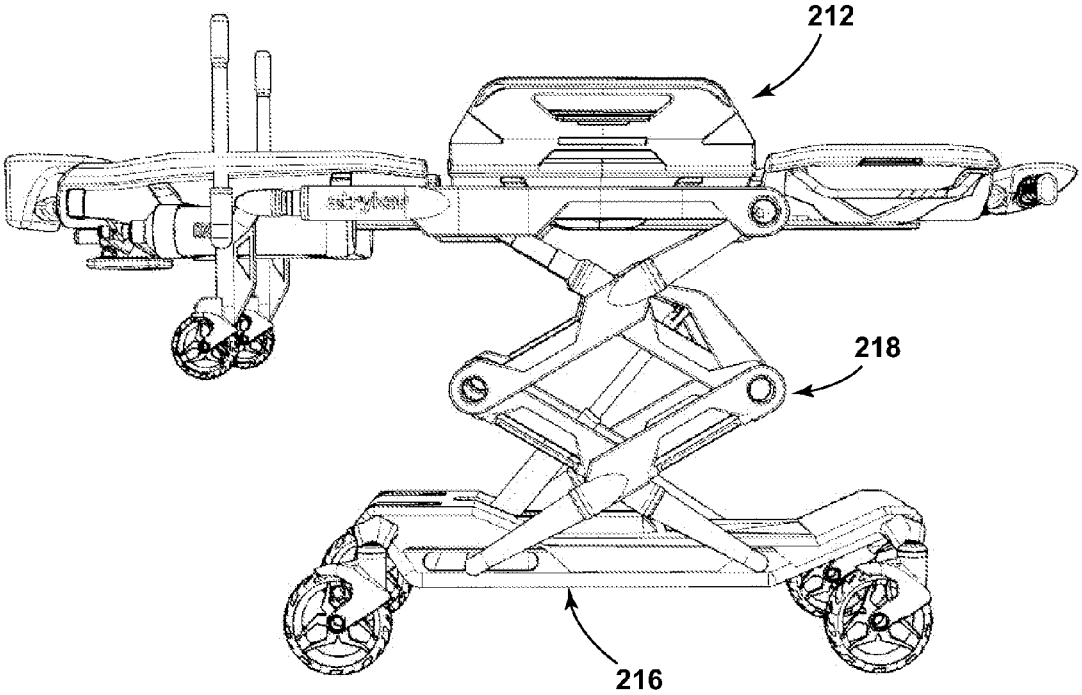
FIG. 23 is another side elevation view of the patient support of FIG. 17 shown in a configuration for supporting a patient in a supine position.

Referring to FIG. 17, the numeral 210 generally designates another embodiment of a patient support. As will be more fully described below, patient support 210 may, similar to support 10, include an articulatable deck to allow the patient support to be configured between a chair configuration, such as shown in FIG. 17, and cot configuration, such as shown in FIG. 23. Further, the patient support, similar to support 10, optionally includes a lift mechanism which has a compact configuration that can provide a great range of motion. In addition, the lift mechanism may be configured to tilt the deck section to provide a more comfortable sitting arrangement for a patient supported on the patient support when the patient support is a chair configuration.

In another aspect, the patient support may incorporate a releasable litter deck so that the deck may be removed for use as or on another patient support. For example, the litter deck may be transferred to another patient support frame or removed for replacement with another litter deck to thereby customize the patient support. Or the litter may be configured to be removed and then unfolded into a chair configuration, such as a stair chair configuration. In this manner, support 210 may provide increased versatility.

Referring again to FIG. 17, patient support includes a litter deck 212, which is supported on a frame 214 and a base 216, which supports the frame and the deck by way of a lift mechanism 218. In the illustrated embodiment, lift mechanism 218 comprises a double X-frame lift mechanism with a pair of lower X-frames 218*a* and a pair of upper X-frames 218*b*, which are joined at their respective upper and lower ends by pivot connections 220*a* and 222*a*. The lower ends of lower X-frame members 218*a* are pivotally joined to base 216 with one of the lower ends being slidably, pivotally mounted to the base and the other pinned to the base. Similarly, the upper X-frame members are pivotally mounted to frame 214 with one upper end being slidably pivotally mounted and the other end pinned, which is beneath the pinned ends of the upper X-frames. In this manner, when the X-frames are pivoted about to their respective central pivot axes 220 and 222, frame 214 and hence deck 212 will be lowered or raised relative to base 216, as would be understood by those skilled in the art. Further, the deck will shift in the direction of the head end of the base.

Figure 19:
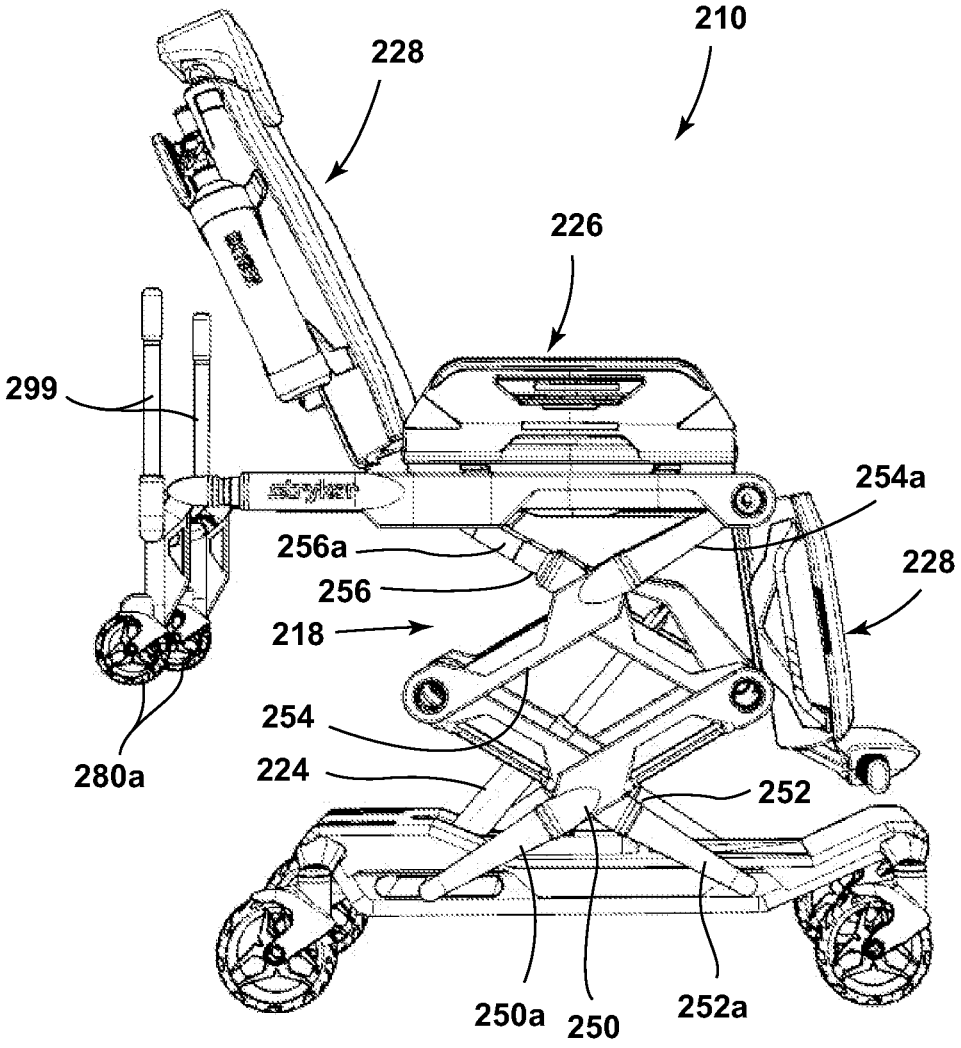
FIG. 19 is a side elevation view of the patient support of FIG. 17.
Figure 21:
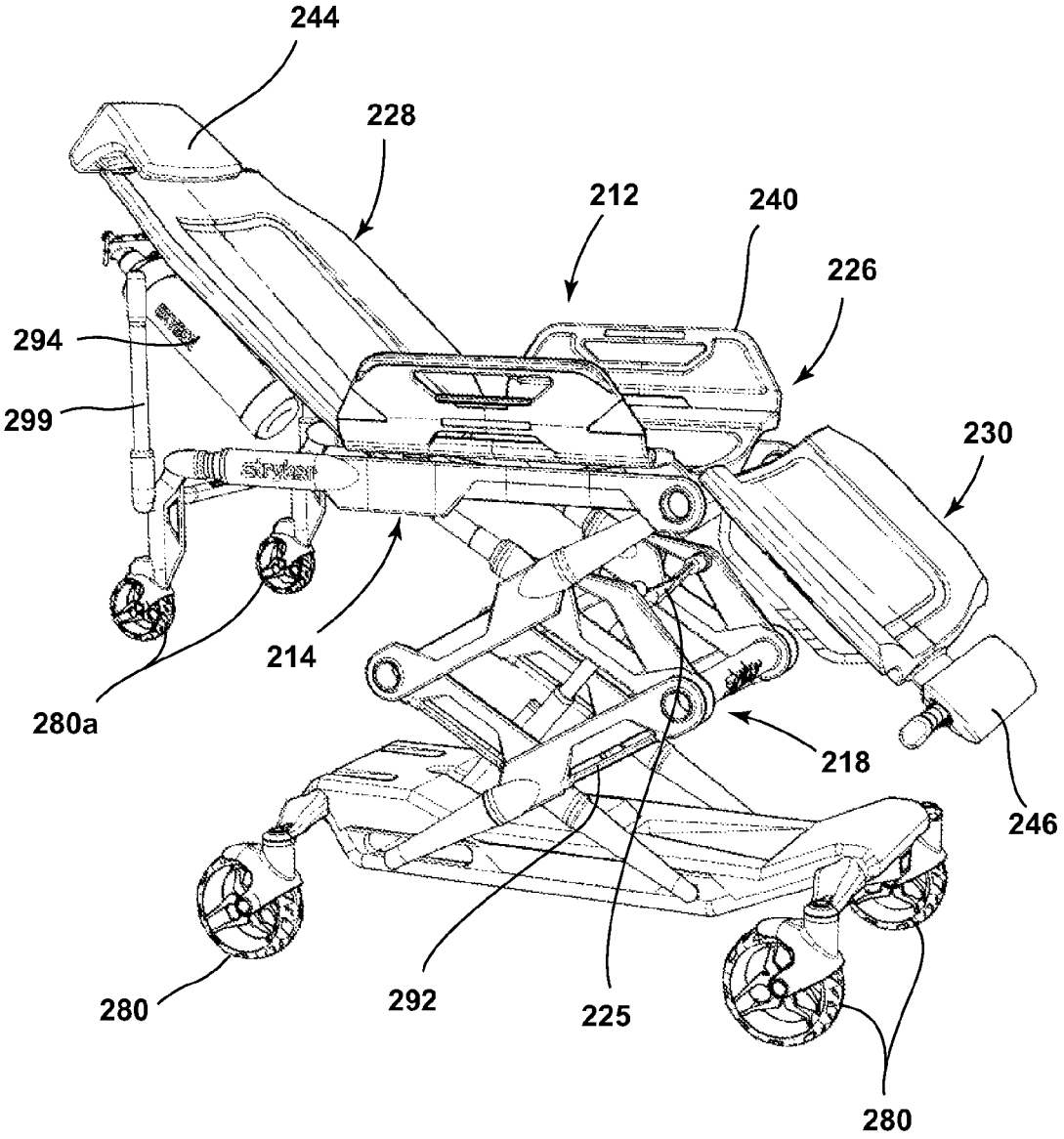
FIG. 21 is another perspective view of the patient support of FIG. 17.
Figure 22:
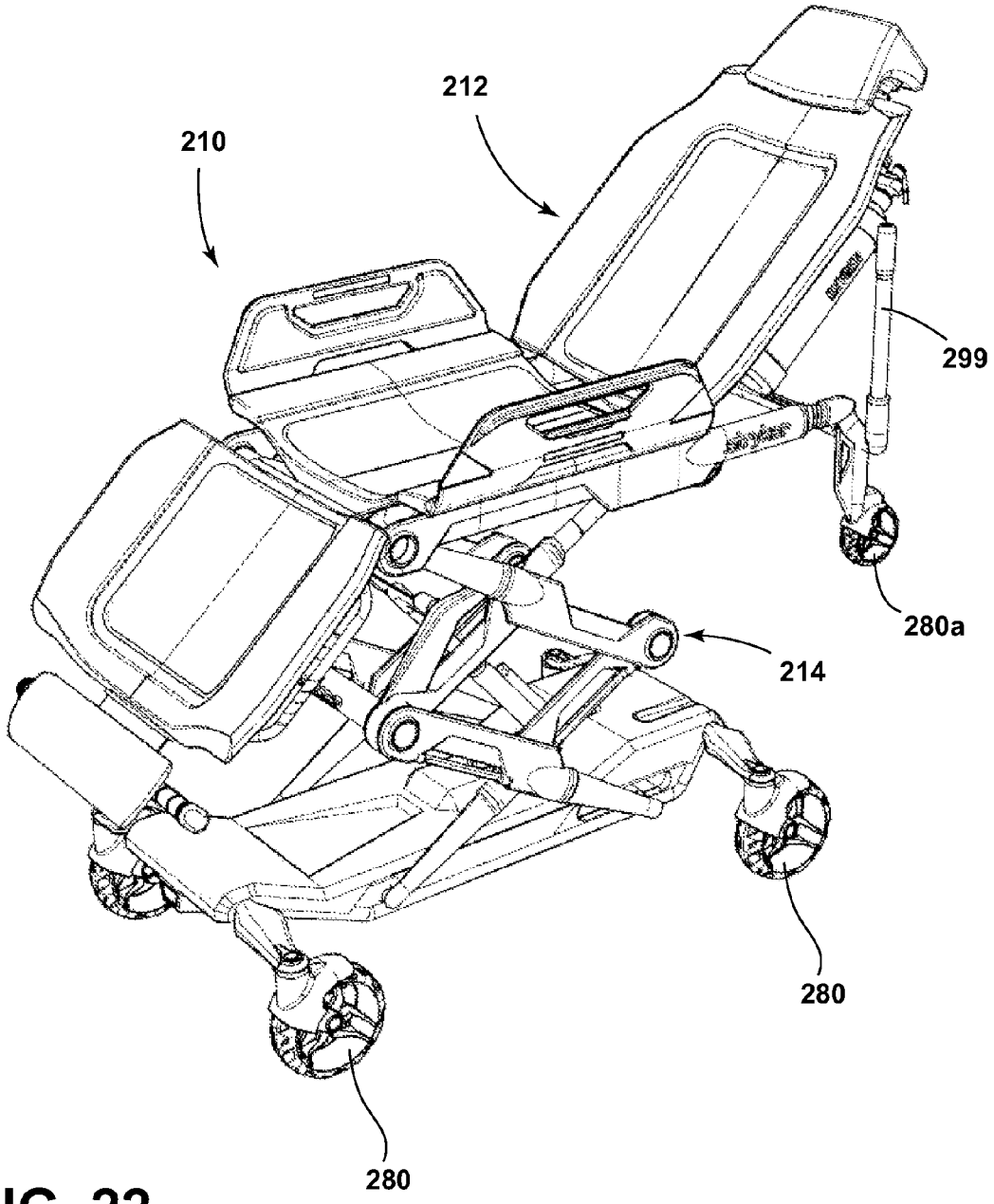
FIG. 22 is yet another perspective view of the patient support of FIG. 17.

The unfolding and folding of the respective X-frames is provided by a driver 224, which is best illustrated in FIG. 19, for example, in the form of a cylinder, such as an electrically actuated cylinder, which is mounted on one end to base 216, for example, by way of a pivot connection, such as a bushing, and pivotally mounted by a bushing at its opposed end to a transverse rod 225 (FIG. 21), which is mounted between the arms of the upper X-frame members, as described below.

Figure 24:
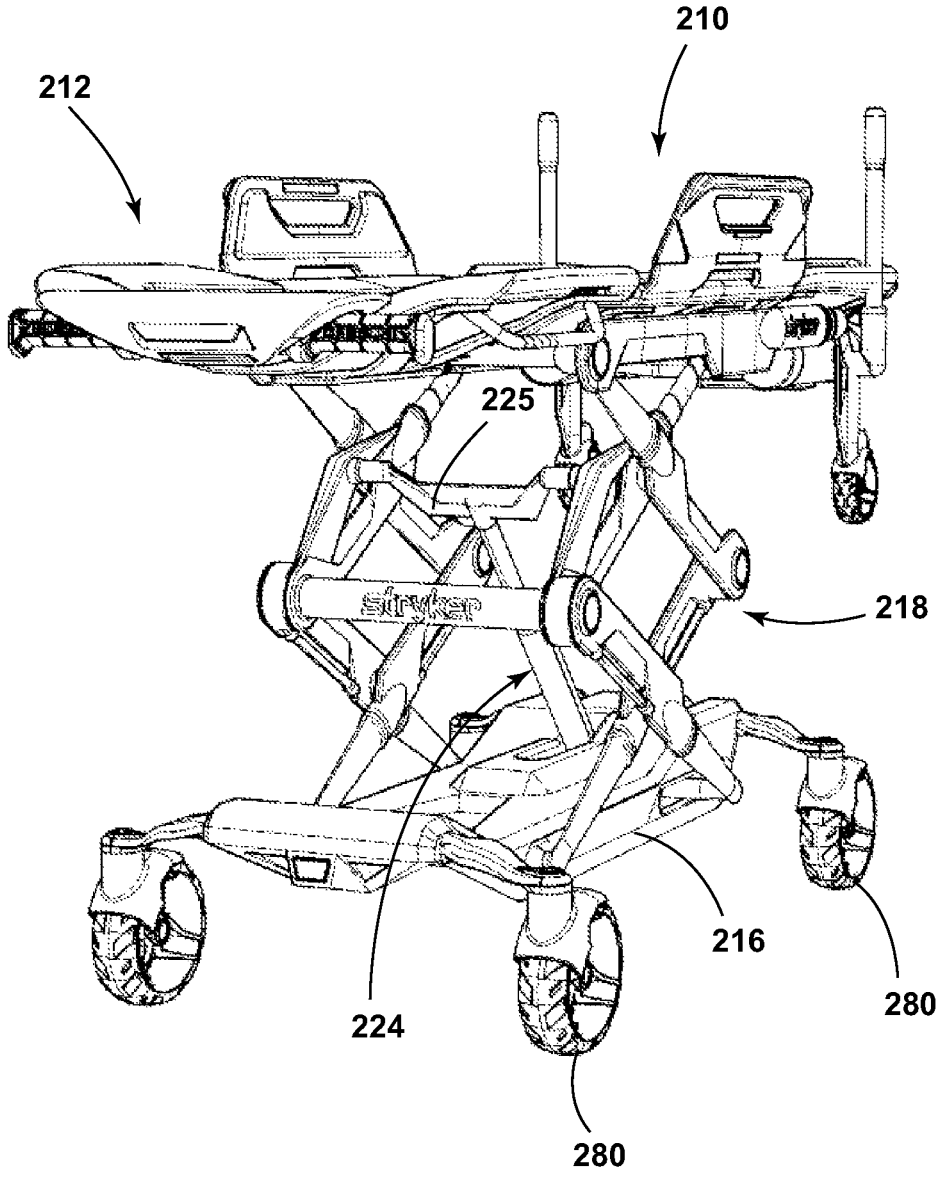
FIG. 24 is a perspective view of the patient support in the configuration shown in FIG. 23.

Referring to FIG. 24, deck 212 includes a seat section 226 and a head section 228 and a foot section 230, which are each articulatable relative to the seat section 226 and independently articulatable relative to the seat section 226 and further with respect to lift mechanism 218. Each section may include a frame and a skin to support pads described below. Alternately, one or more of the seat section, head section, and foot section may comprise a perimeter frame and a pad supported by said frame, wherein the pad is exposed on both sides of the respective section. For example, the pad (or pads) may comprise a core cushioning member and a base supporting the cushioning member, with both the base and cushioning member enveloped in a cover, such as a liquid impermeable cover, such as vinyl. The base may be formed form a variety of materials that provide stiffness to the cushioning member. For example, the base may be solid or a mesh or a lattice and be formed from wood, metal, plastic, including plastic reinforced, for example with fibers or the like or a combination thereof. The base may also be formed from discrete members, such as strips or batons.

Figure 25:
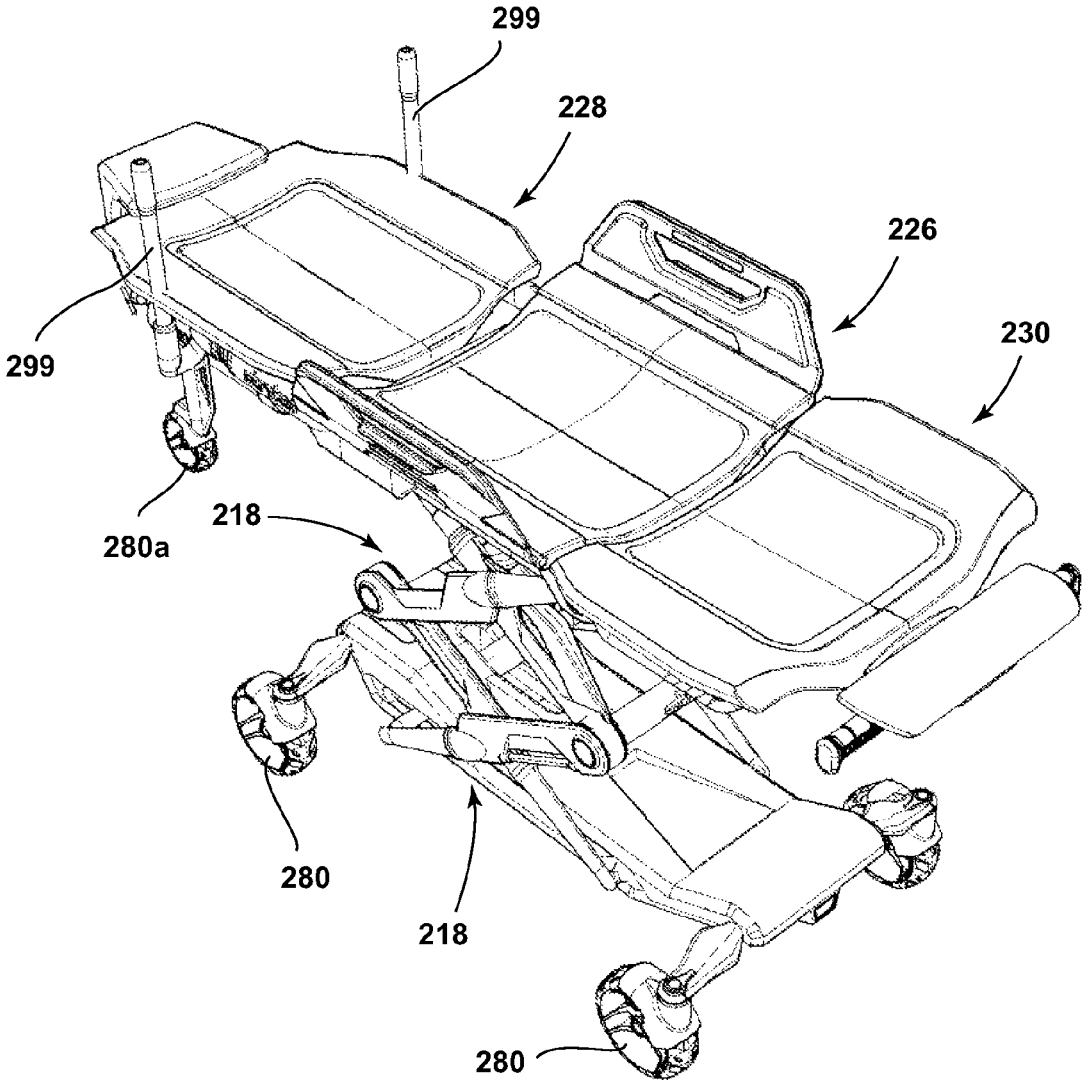
FIG. 25 is a top perspective view of the patient support in the configuration shown in FIG. 23.

Each respective section of the deck may include a pad to thereby form a sectioned support surface for a patient. The respective pads are sized and configured (and gatched) such that the deck sections may be moved between the chair configuration as shown in FIGS. 17-22, and further the cot configuration such as shown in FIGS. 23-25 without running interference with the adjacent pad. Additionally, the pad sections 228*b* and 230*b* may include laterally extending lips 228*c* and 230*c*, respectively, which optionally extend beyond the supporting framework of the deck to reduce the gap and at least partially fill the space between the deck and adjacent support surface to facilitate a patient transfer from the cot to the adjacent support surface.

Seat section 226 optionally includes side rails 240 that are pivotally mounted about the opposed sides of seat section 226 to frame 214. Side rails 240 may each include a hand hold 242 and further may be provided with a pad 240*a* to provide cushioned lateral support to a patient supported on support 210.

Side rails 240 are mounted in a generally vertical orientation relative to seat section 226 and may further be released from their generally vertical orientation to an angle relative to the support surface to increase the width of the deck at least of the seat section of the deck. For example, side rails 240 may be configured to be tilted in a range from a generally vertical orientation, such as about 80-90 degrees relative to the patient deck at seat section 226 to an angle in a range from about 30-50 degrees relative to the seat section, and optionally no more than 45 degrees to avoid creating any instability issues.

In addition to foot section 230 and head section 228, deck 212 may also incorporate extendible head and foot rests 244, 246 which may be mounted on telescoping tubes to thereby extend the length of the deck to accommodate taller patients. Telescoping tubes 244*a* and 246*a* may be moved manually, for example, and further may provide resistance to movement of the respective head rest and foot rest (and provide infinite positioning between a fully extended position and retracted position) or may include detent mechanisms to provide defined positions for the respective rests. Alternately, the rests may be moved by actuators, such as electrically powered actuators.

Figure 19A:
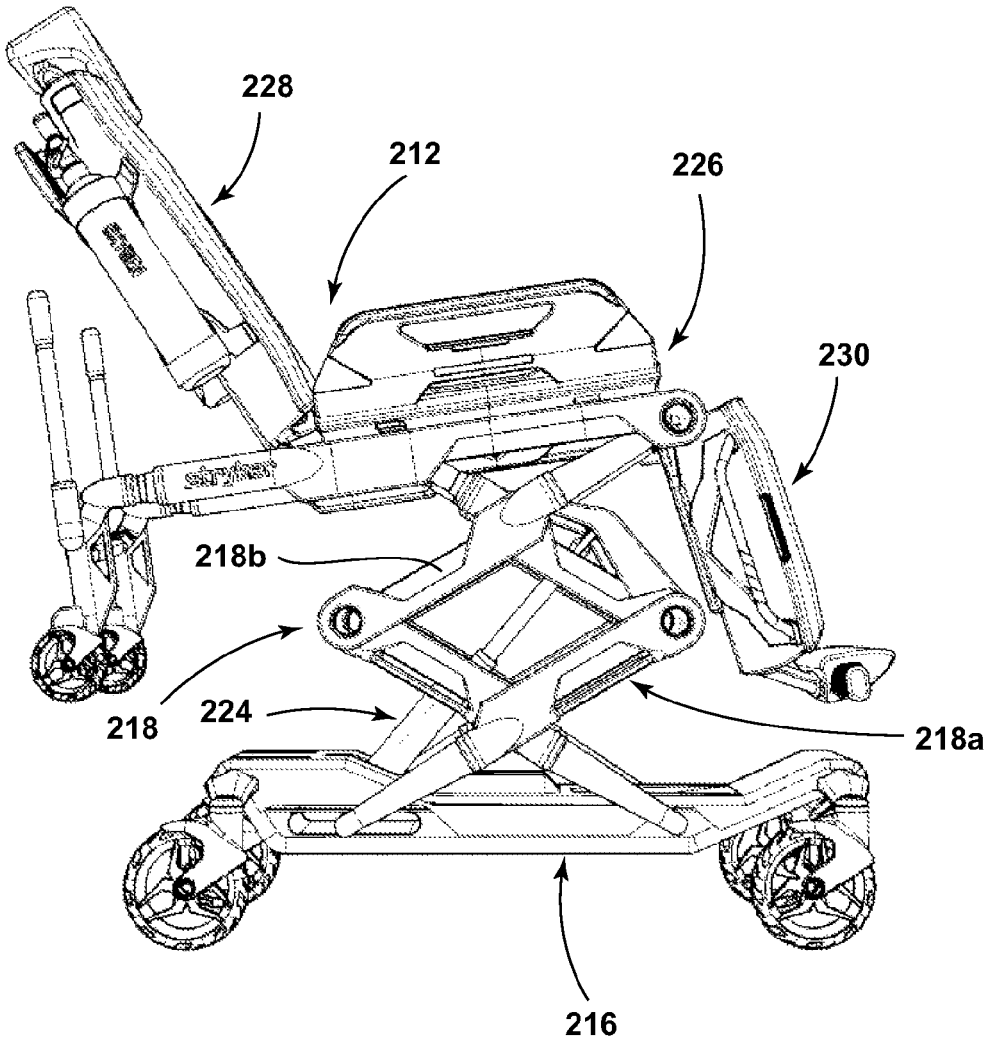
FIG. 19A is a side elevation similar to FIG. 19 showing the deck tilting.
Figure 19B:
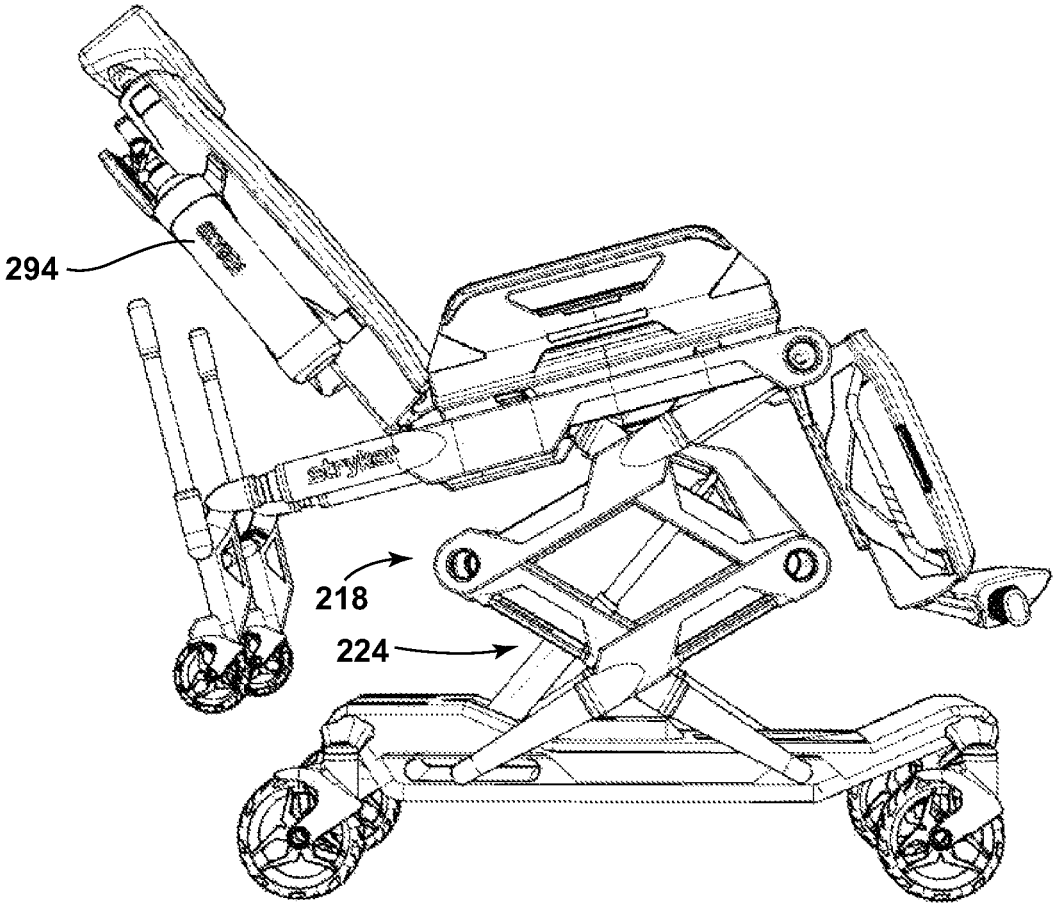
FIG. 19B is a side elevation similar to FIG. 19 showing the deck tilting to an even greater angle.

Referring again to FIGS. 19 and 19A, X-frames 218*a*, 218*b* of lift mechanism 218 are formed by pivotally joined arms 250 and 252, and 254 and 256, respectively. Each arm 250, 252, 254, and 256 may include a telescoping arm 250*a*, 252*a*, 254*a*, and 256*a*, respectively. The telescoping arm sections of X-frames 218*a* may be pivotally mounted to base 216, with the telescoping arms 254*a*, 256*a* being pivotally mounted to frame 214. Therefore, in addition to folding about the respective pivot axes, the respective arms of the X-frames can be extended or contracted to thereby tilt deck 212 such as shown in FIGS. 19A and 19B. In this manner, when a patient is supported on the deck 212, and patient support 210 is in its stair chair configuration, such as shown in FIGS. 17-26, a patient may be tilted relative to the lift mechanism and therefore relative to the base at an angle that is more comfortable for patient, for example in a range of 0 (zero) degrees to plus or minus about 40 degrees from horizontal. Further, lift mechanism 218 may tilt deck 212 when in its cot configuration to tilt the deck into a Trendelenberg or reverse Trendelenberg configuration.

Figure 20:
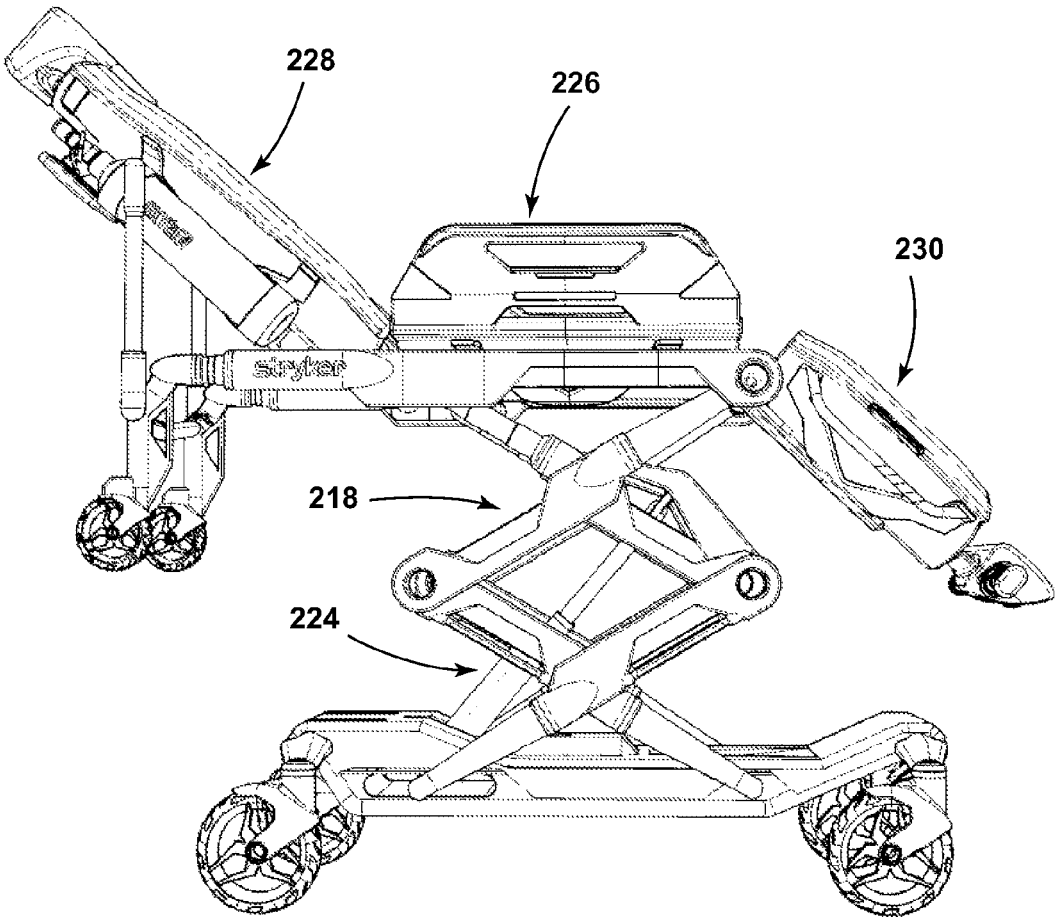
FIG. 20 is another side elevation view of the patient support of FIG. 17.

As best seen in FIGS. 17, 24 and 25, arms 250 may be joined together by a transverse member, such as a transverse rod 252*a*. Similar, arms 254 may be joined by transverse rod 225 (FIG. 26) by way of offsetting arms 254*b* (FIG. 20). With this configuration, the lift mechanism may have a compact configuration, which can provide a greater range of motion and further may allow the deck to be lowered to a low height of less than 14", less than 13" and as low as 12".

Actuator 224 may be controlled by controls mounted to support 210 including, for example, a wireless motor control provided for example by a user interface 272, mounted for example to a rail 278 provided on the back of head section 228. In the illustrated embodiment user interface 272 comprises a touch screen 274.

Referring to FIGS. 17-26, support 210 also may incorporate a plurality of caster wheels 280. For example, suitable caster wheels are available from Tente. In addition, caster wheels 280 may be mounted to axles rotatably mounted in base 216 by bushings and further with springs, such as torsional springs, which may provide a more cushioned ride for the patient. For an example of a suitable shaft and spring reference is made to co-pending U.S. patent application Ser. No. 13/783,699, entitled PATIENT SUPPORT, filed on Mar. 4, 2013, which is which is incorporated by reference herein in its entirety and commonly owned by Stryker Corporation of Kalamazoo, Mich.

In addition, support 210 may incorporate its plurality of lights, such as light strips 292 similar to light strips 92 described above, to provide various functions.

Referring again to FIGS. 25 and 26, head section 228 may similarly include a support 296 mounted to the framework of head section 228 at the back of the deck, which forms receptacles 298 for receiving respective oxygen bottles 294 and also may include controls provided, for example, in handles 299, which may be mounted to frame 214. In the illustrated embodiment, handles 299 comprised fixed tubes located and mounted at the head end of frame 214 and further may be commonly mounted to a transverse support 299*a*, which may be configured as a handle and a mounting structure for head end caster wheels 280*a*. Head end casters wheels 280*a* are supported from frame 214 to support the head end of support when support 210 is in a folded configuration when deck is lowered and, for example, when support 210 is being loaded for example into an emergency vehicle, such as into the back of an ambulance.

Figure 29:
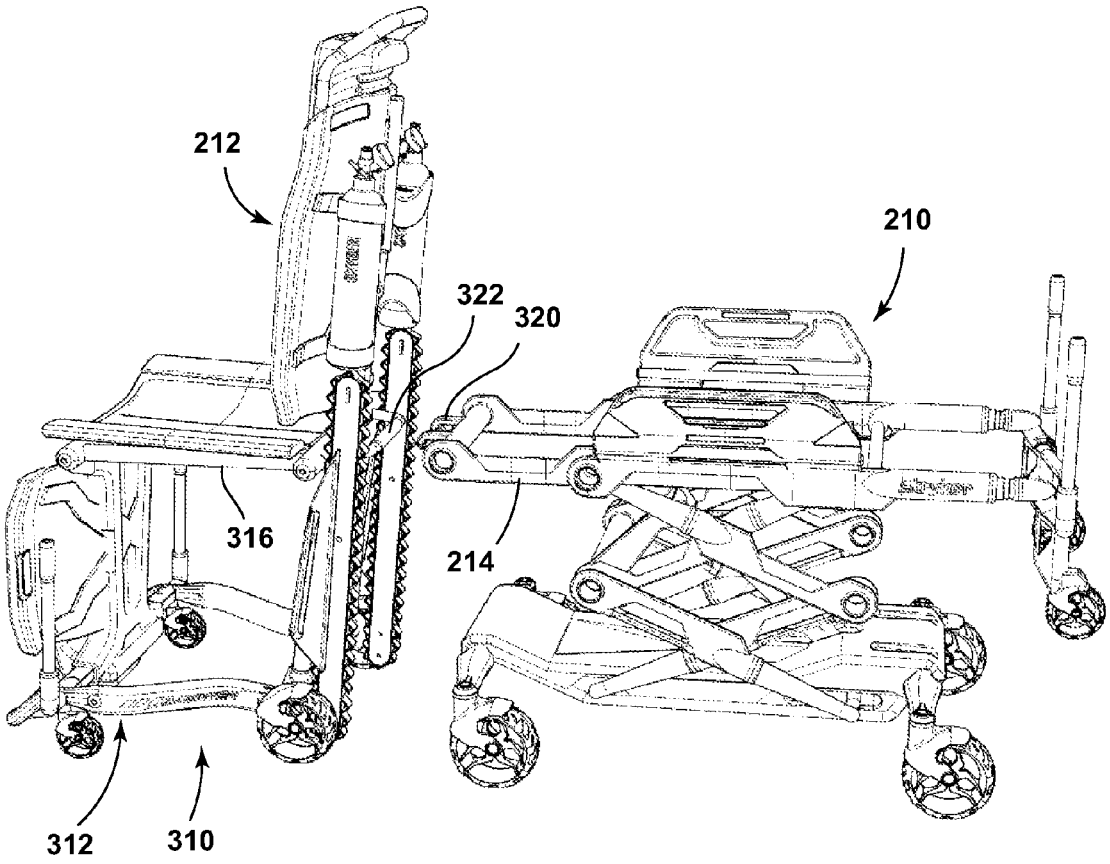
FIG. 29 is a similar view of FIG. 27 with the stair chair moved further away to show the back of the stair chair engagement structure.

Referring now to FIGS. 23-25, as previously noted, deck 212 may be reconfigured such that seat section 226, head section 228, and foot section 230 lie in a generally common plane to thereby form a cot configuration for support 210. Further, as noted the deck may be positioned in a generally horizontal orientation, such as shown in FIG. 29 or may be tilted in a Trendelenberg or reverse Trendelenberg configuration. This may be achieved by the tilting of deck sections by way of lift mechanism 218. As would be understood from the description, the lift mechanism, allows the deck to tilt even when in its chair configuration to provide a more comfortable sitting arrangement for a patient supported on the patient support. In addition, with the dual X-frame configuration the foot section can be lowered into a chair position even when said X-frames are in a lowered position. For example, the X-frames as shown may be configured to remain in a footprint defined by the seat section when the X-frames are fully collapsed to their lowest position with clearance for articulated foot section to be moved to a seated to provide a compact mechanism while still retaining a full range of motion.

Figure 26:
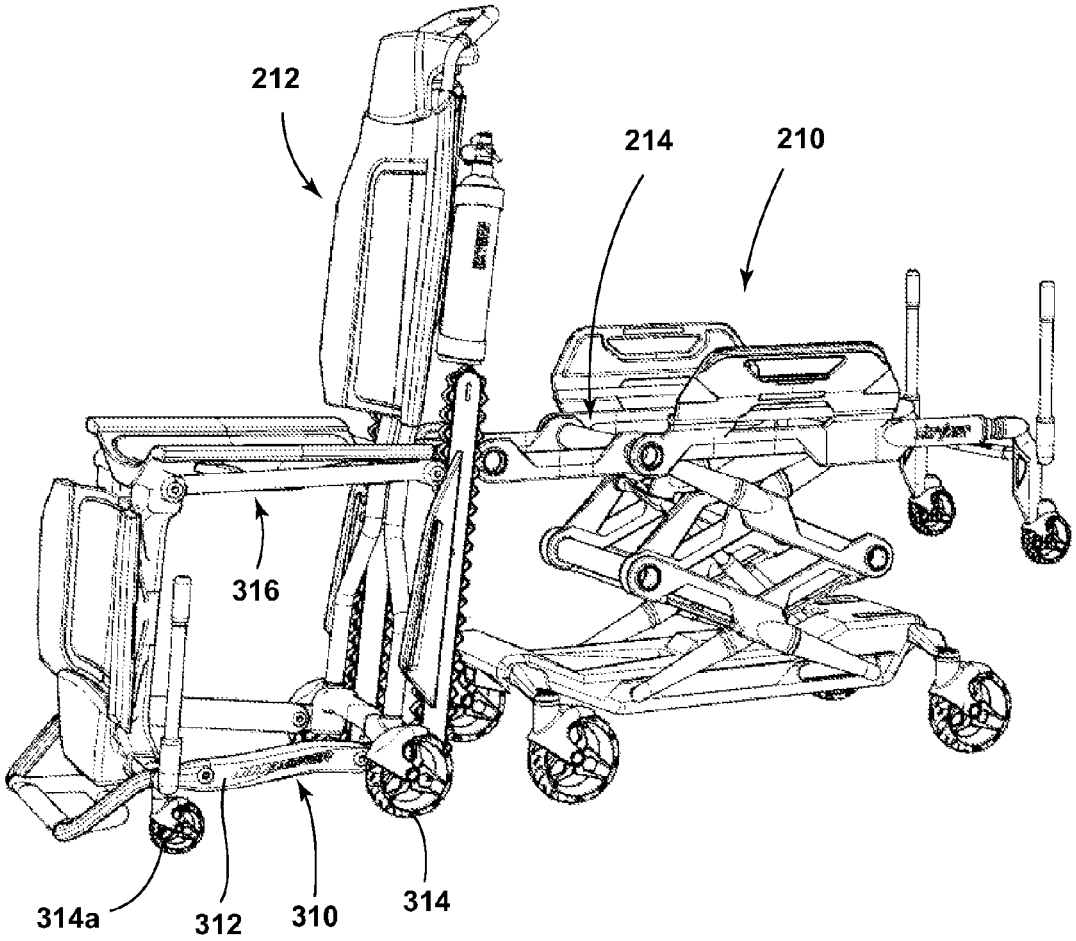
FIG. 26 is another perspective view of the patient support in the configuration shown in FIG. 23 with the litter deck removed and transferred to a stair chair frame in a chair configuration to form a patient support system.

Referring to FIG. 26, the numeral 310 generally designates a stair chair frame with a base 312, which supports a plurality of rear and forward casters 314, 314*a* and further which supports seat frame 316 on which the litter deck 212 which, after being decoupled from frame 214 of support apparatus 210, can be coupled to thereby transfer the litter deck from support 210 to stair chair frame 310 and thereby form a stair chair.

Figure 27:
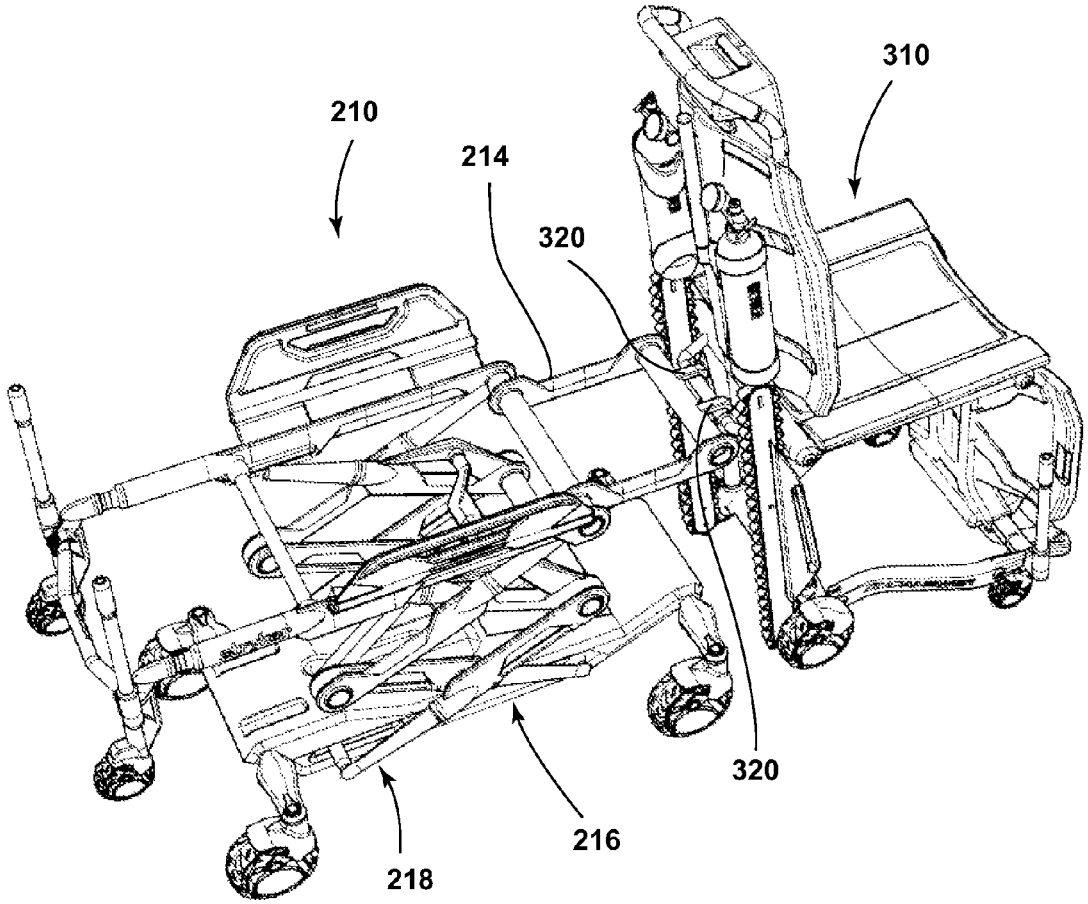
FIG. 27 is another perspective view of the patient support in the configuration shown in FIG. 26.

For example, the patient support 210 may be positioned in its cot configuration such as shown in FIG. 26 and FIG. 25, and placed adjacent to the frame of stair chair frame 310, such as shown in FIG. 26, for example, at the foot end of frame 214. Optionally, as best seen in FIGS. 27 and 29, patient support 210 includes a pair of projecting engagement structures 320, for example, hooks for engaging a rearwardly extending transverse bar 322 mounted to the back of frame 316 of stair chair frame 310. When engaged with bar 322, engagement structures 320 thereby couple the stair chair 310 to patient support 210. Optionally, once coupled and docked, the respective sections of litter deck 212 may be released from engagement with frame 214 of patient support 210 and thereafter moved either as an assembly or individually and then mounted to the respective portions of frame 316 of stair chair frame 310.

Alternately, frame 316 of stair chair may be tilted so that the deck sections support may be transferred over from support 210 to stair chair 310 as an assembly in a sliding or rolling fashion, by way of bearings or bearing surfaces (provided on the respective frames) or the like so that deck 212 may be simply passed over the foot end of frame 214 and onto the head end of frame 316. Once properly positioned, deck 212 may then be coupled to the respective sections of the frame. Suitable reliable mounting mechanisms may include spring loaded or over center clamps.

Another method may include removing the tracks of stair chair 310 first, to provide a less obstructed path between frame 214 and 316. With their removal, the chair may need not be tilted and instead simply coupled to the end of frame 214 by hooks 298 again so that the deck sections may be transferred over from support 210 to stair chair 310 as an assembly.

Figure 30:
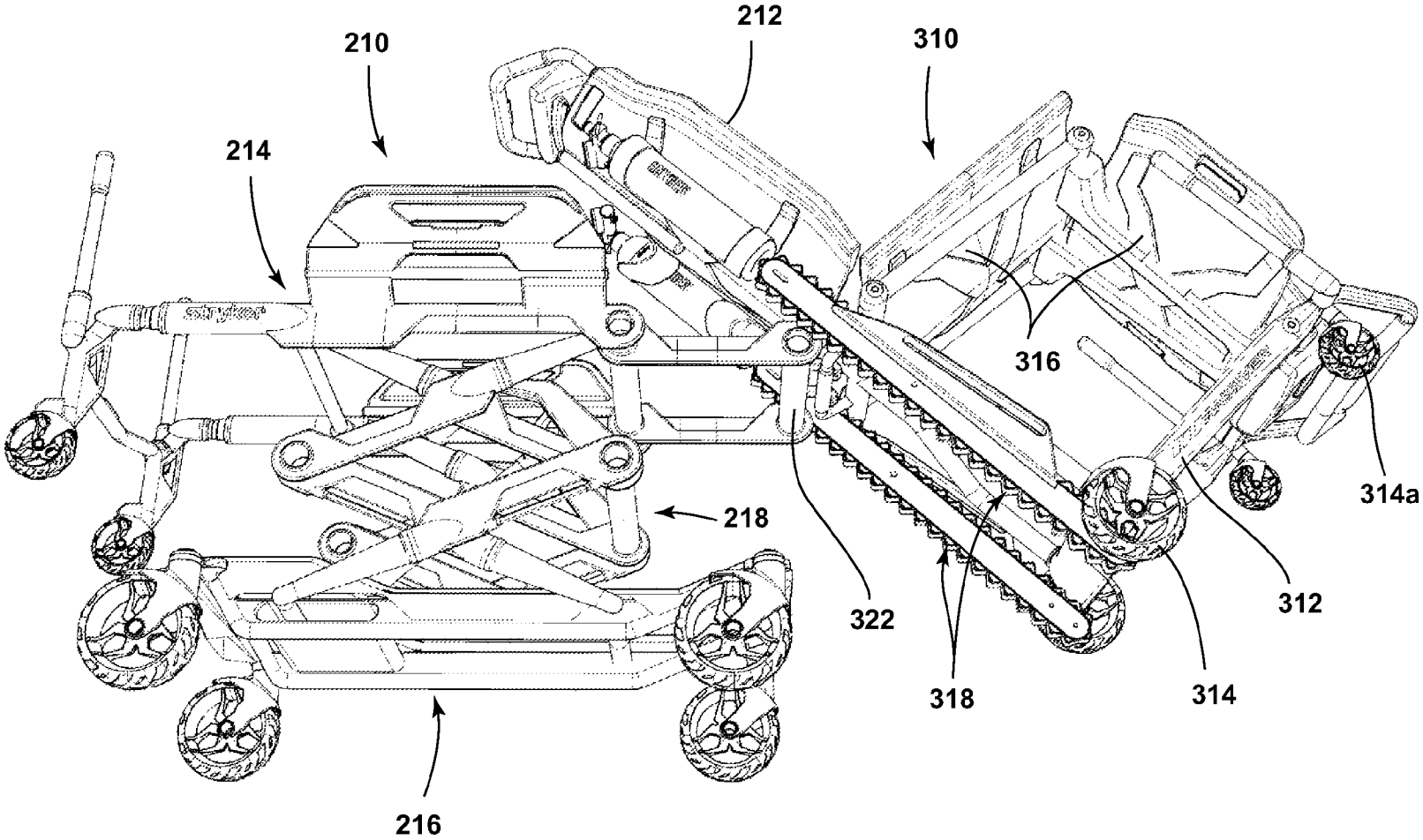
FIG. 30 is a perspective view of another embodiment of the stair chair that mounts onto the base of a cot to form a patient support system.
Figure 31:
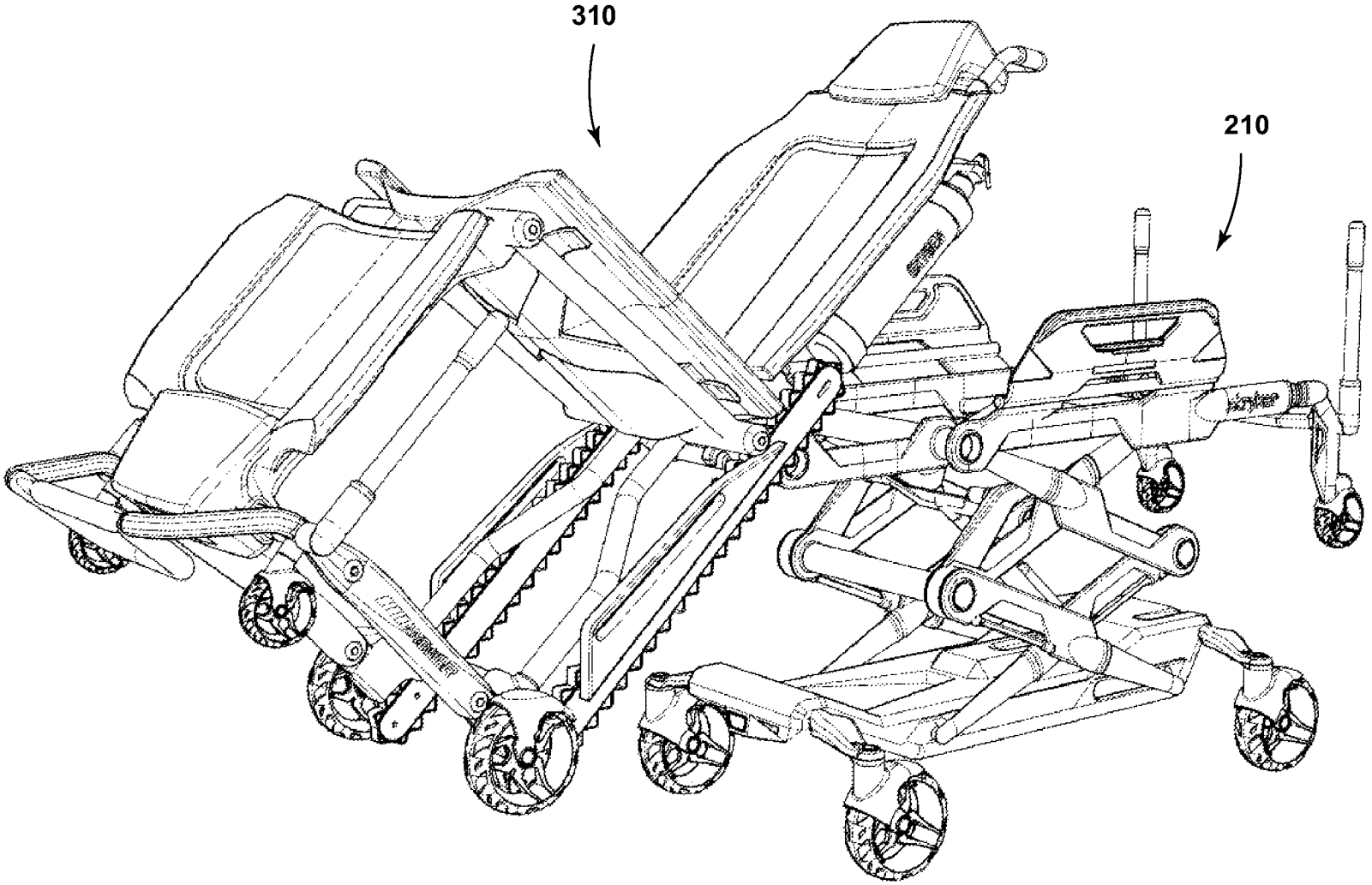
FIG. 31 is another perspective view of the patient support system of FIG. 30.
Figure 32:
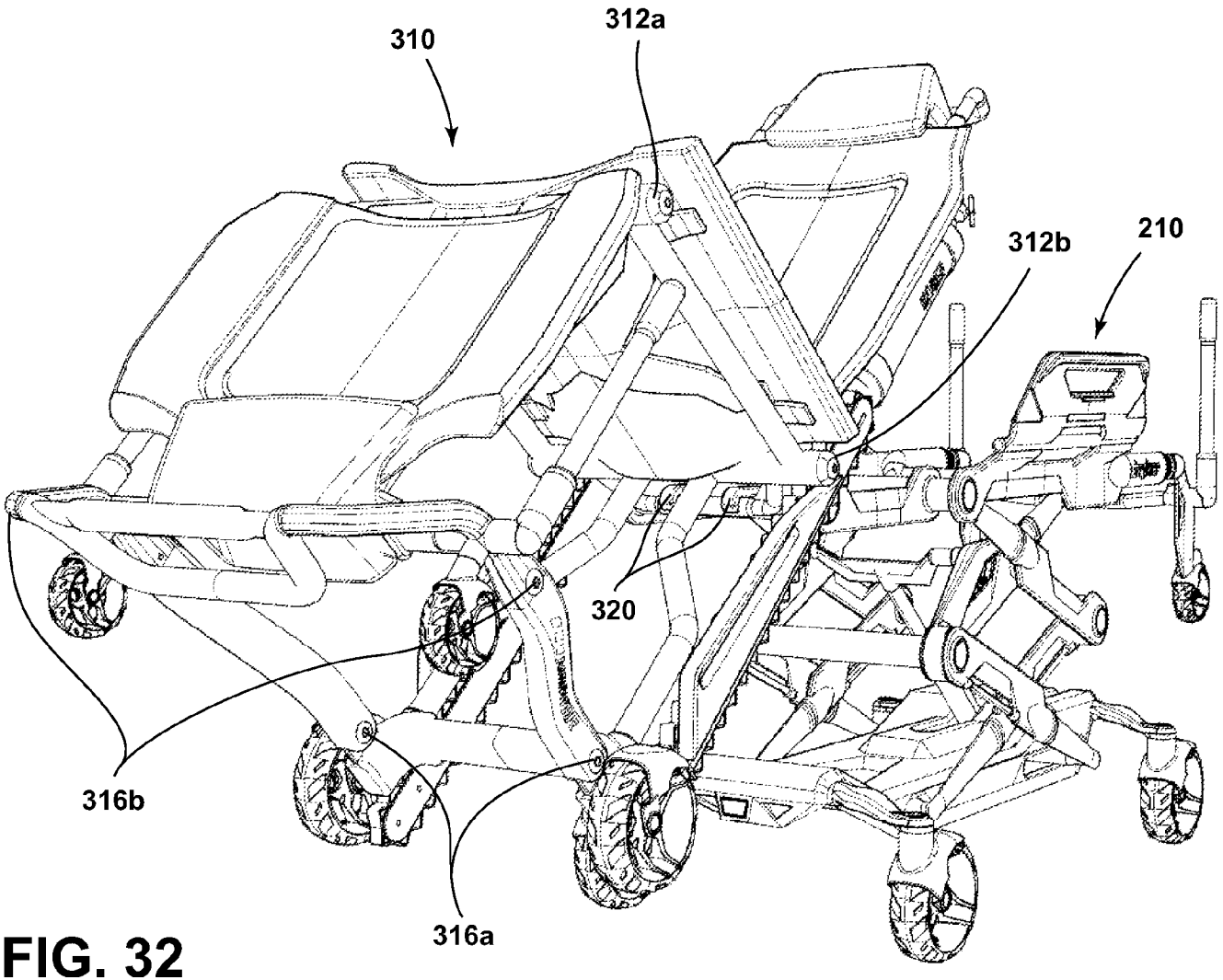
FIG. 32 is another enlarged perspective view of the patient support system of FIG. 30.
Figure 33:
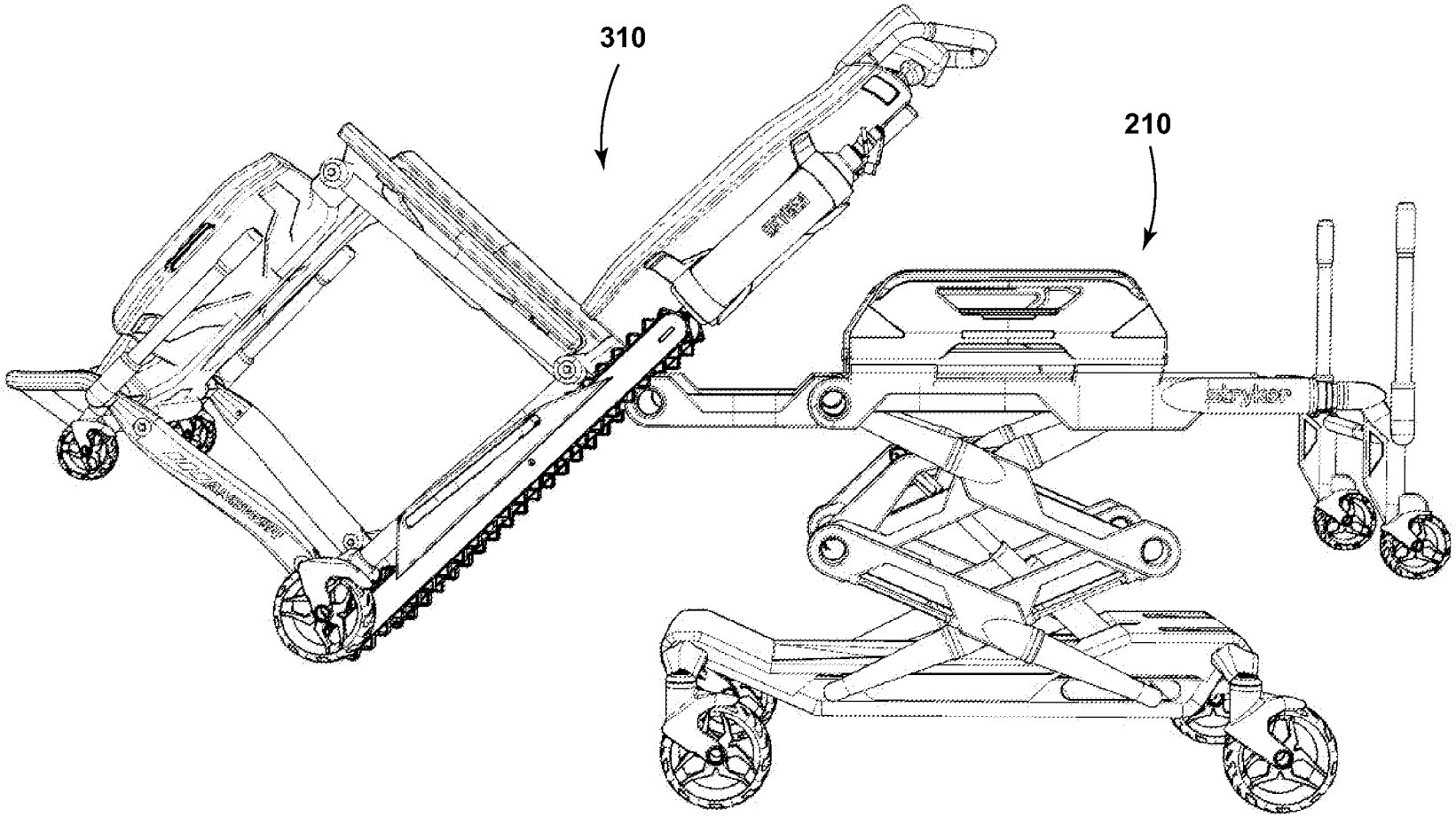
FIG. 33 is a side elevation view of the patient support system of FIG. 30.
Figure 34:
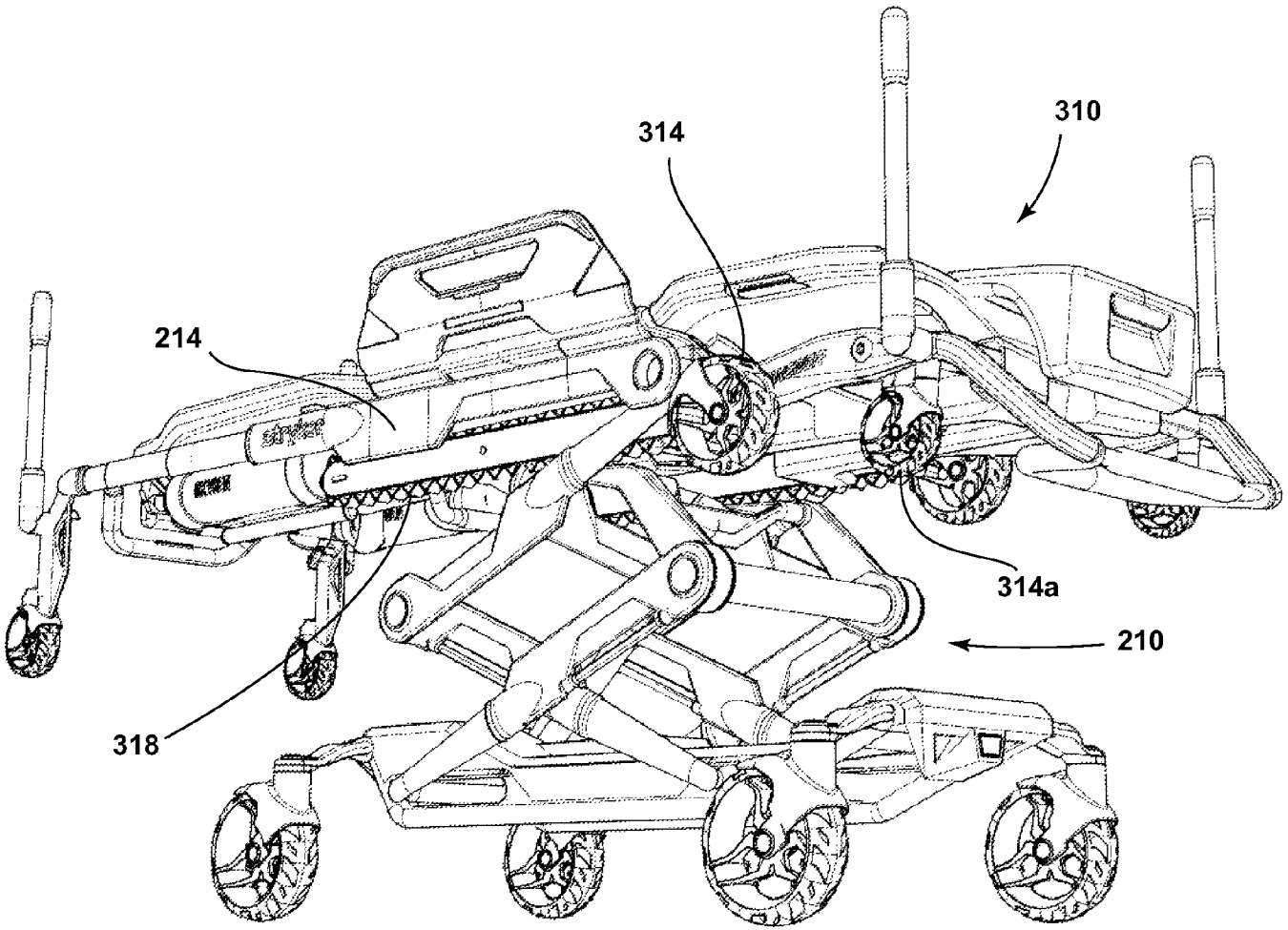
FIG. 34 is a bottom perspective view of the patient support system of FIG. 30 showing the deck in a cot configuration.
Figure 35:
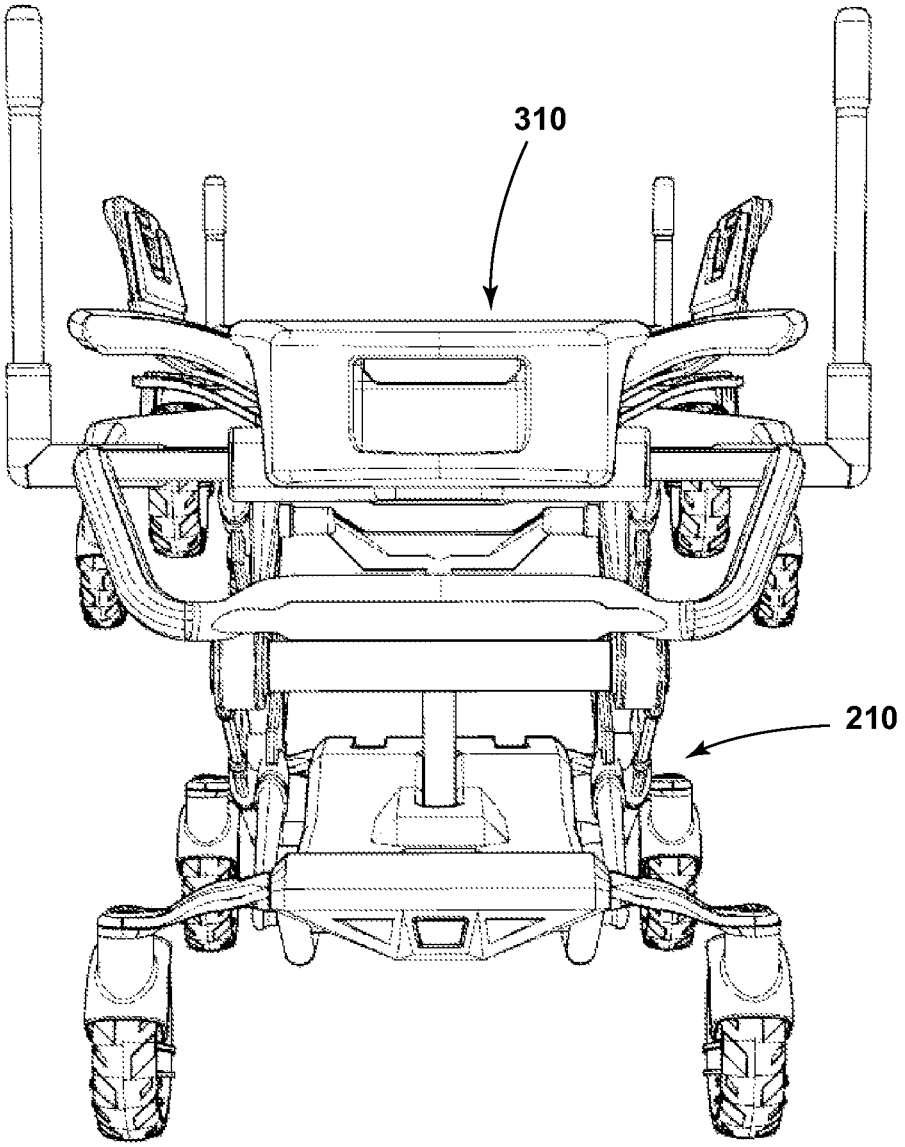
FIG. 35 is a front elevation of the patient support system of FIG. 30.
Figure 36:
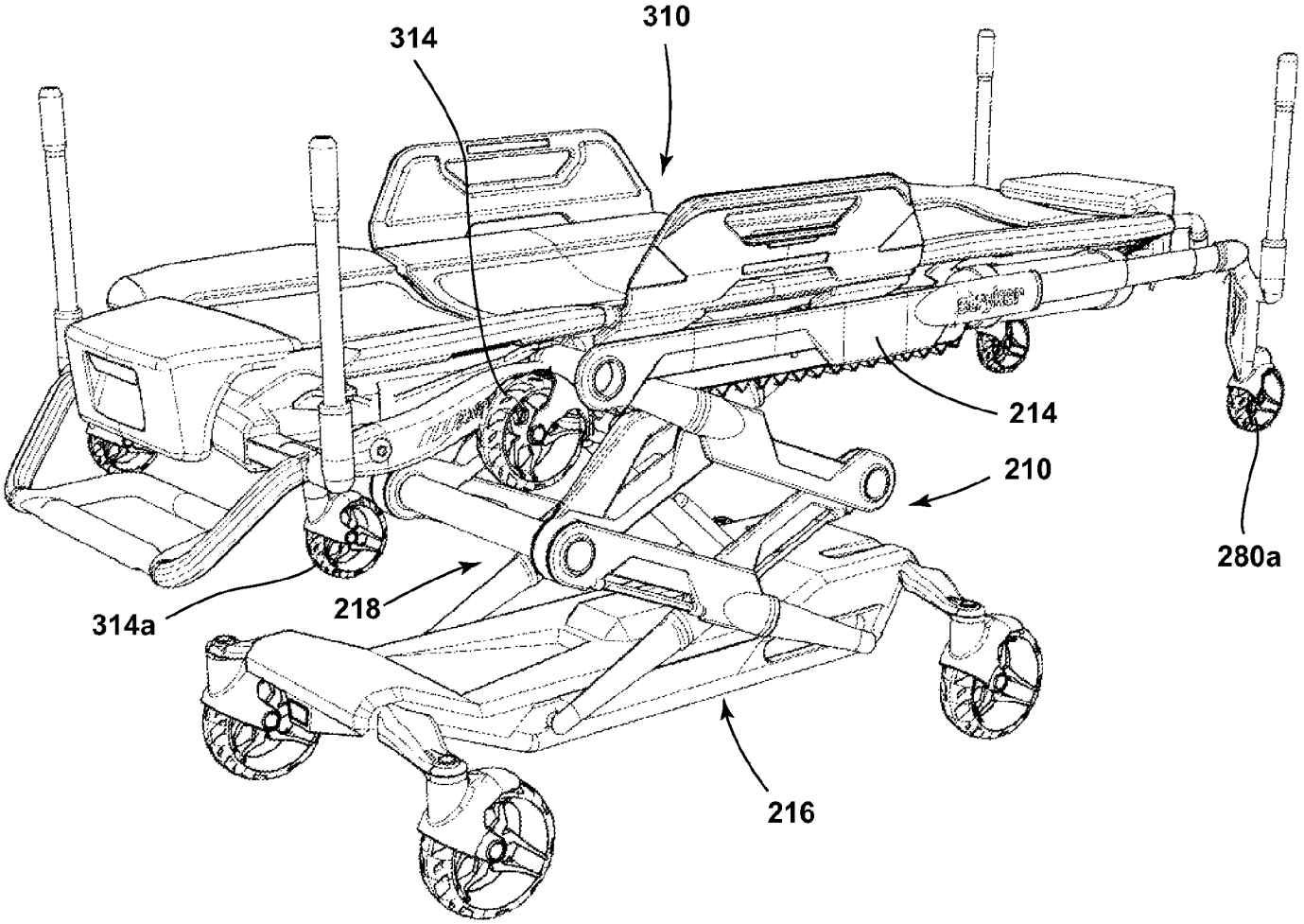
FIG. 36 is a side perspective view of the patient support system of FIG. 30.
Figure 37:
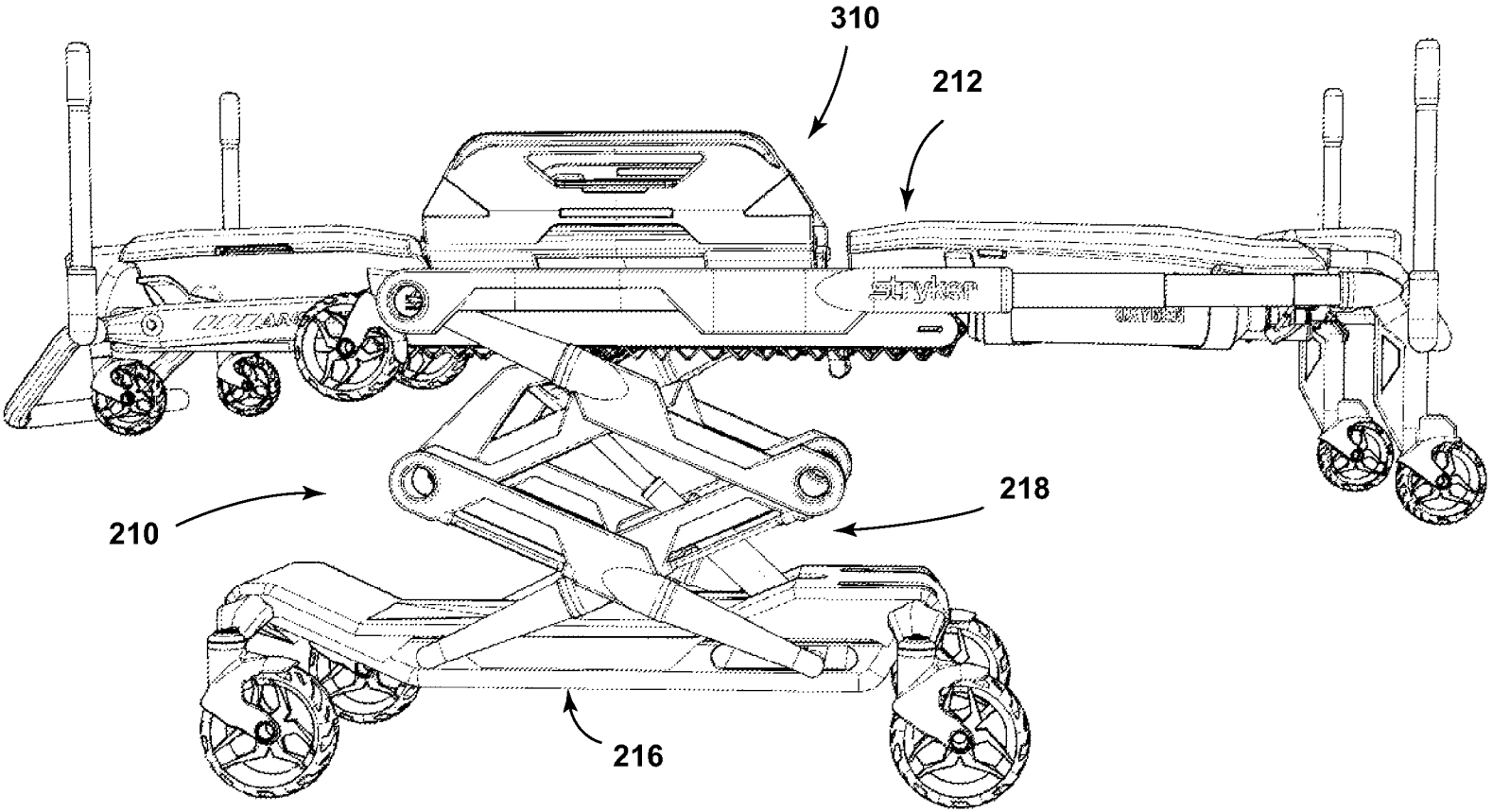
FIG. 37 is another side view of the patient support system of FIG. 30.

In yet another form, as best understood from FIGS. 30-39, stair chair 310 may be moved onto base 214 of apparatus 210 and reconfigured into a collapsed state to forming the litter deck for apparatus 210. Referring to FIG. 30, when hooks 320 are engaged with transverse bar 322, mounted to the back of stair chair 310, stair chair 310 may be lifted and pivoted (FIG. 30-33). Once stair chair 310 is sufficiently tilted over frame 214, the stair chair frame and deck may be collapsed by folding frame 316 about its releasable hinged connections 316*a* and 316*b*. In its collapsed state as shown in FIG. 34, the sections of deck 212 can pivot about its hinged connections 312*a*, and 312*b*, can lie in a generally horizontal configuration along with frame 316 and tracks 318.

Figure 28:
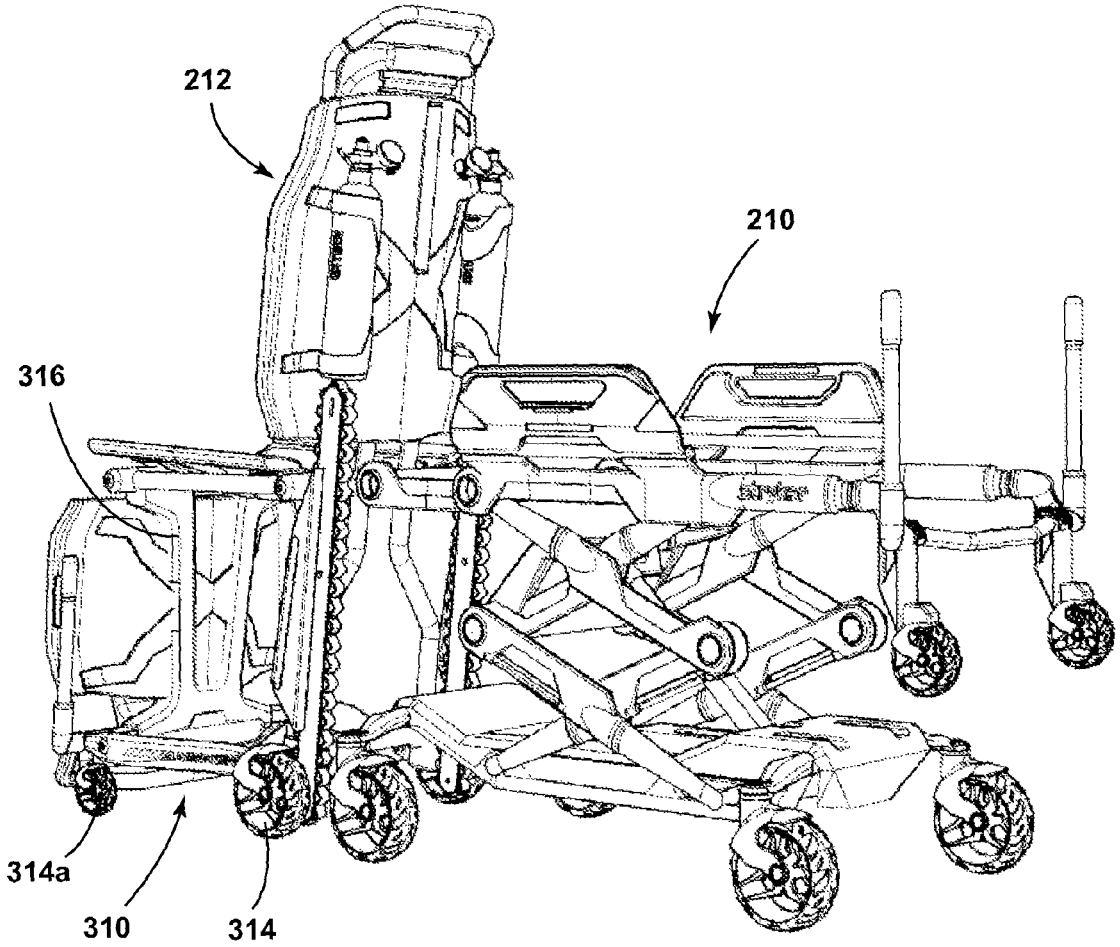
FIG. 28 is another perspective view of the patient support in the configuration shown in FIG. 26.

Further the tracks may facilitate the transfer of stair chair 310 onto support 210 and/or removal of chair 310 from patient support 210. After the stair chair 310 is then transferred off frame 214 of patient support 210, it may then be reconfigured in a stair chair configuration such as shown in FIGS. 27-29.

To facilitate the transfer of a deck section or chair 310 onto support 210 either the deck section or respective frames may incorporate rollers or bearings or segmented channels into which the tracks of the stair chair can be guided.

Figure 38:
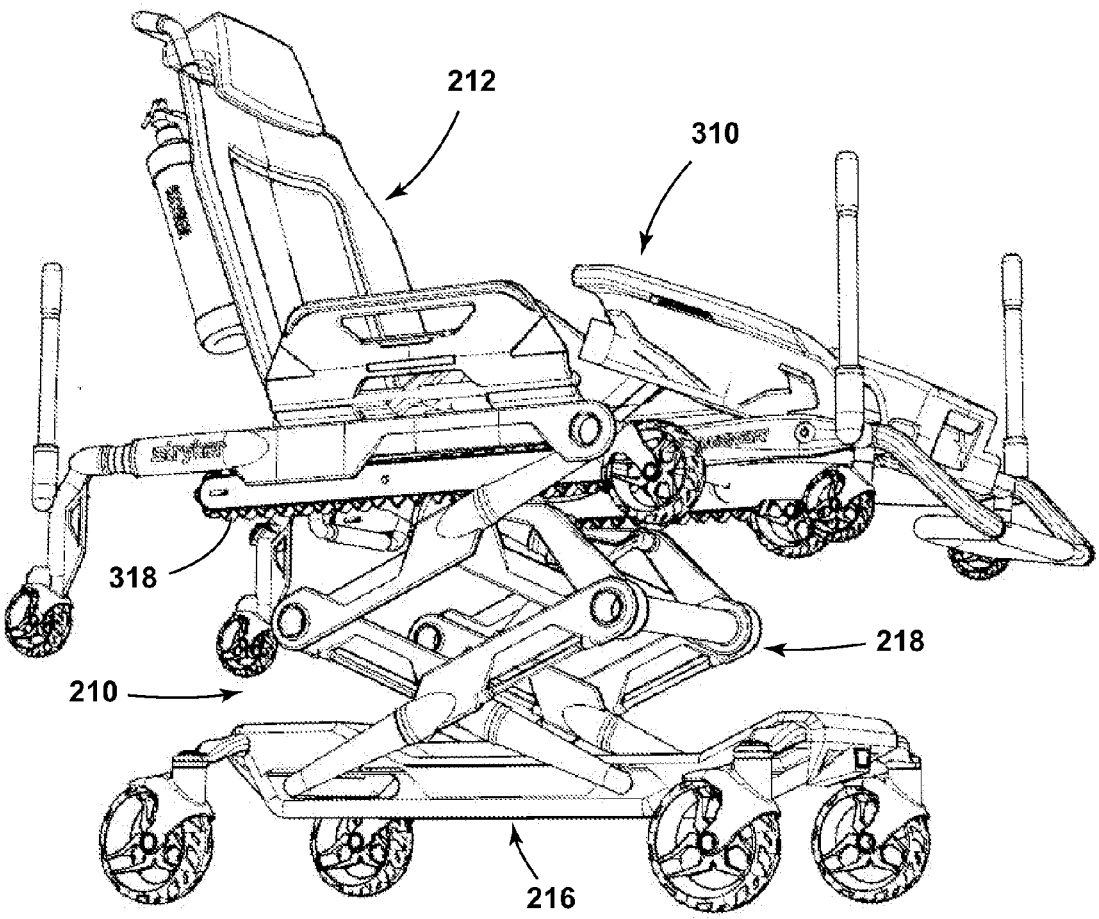
FIG. 38 is another perspective view of the patient support system of FIG. 30 showing the deck in a chair configuration.
Figure 39:
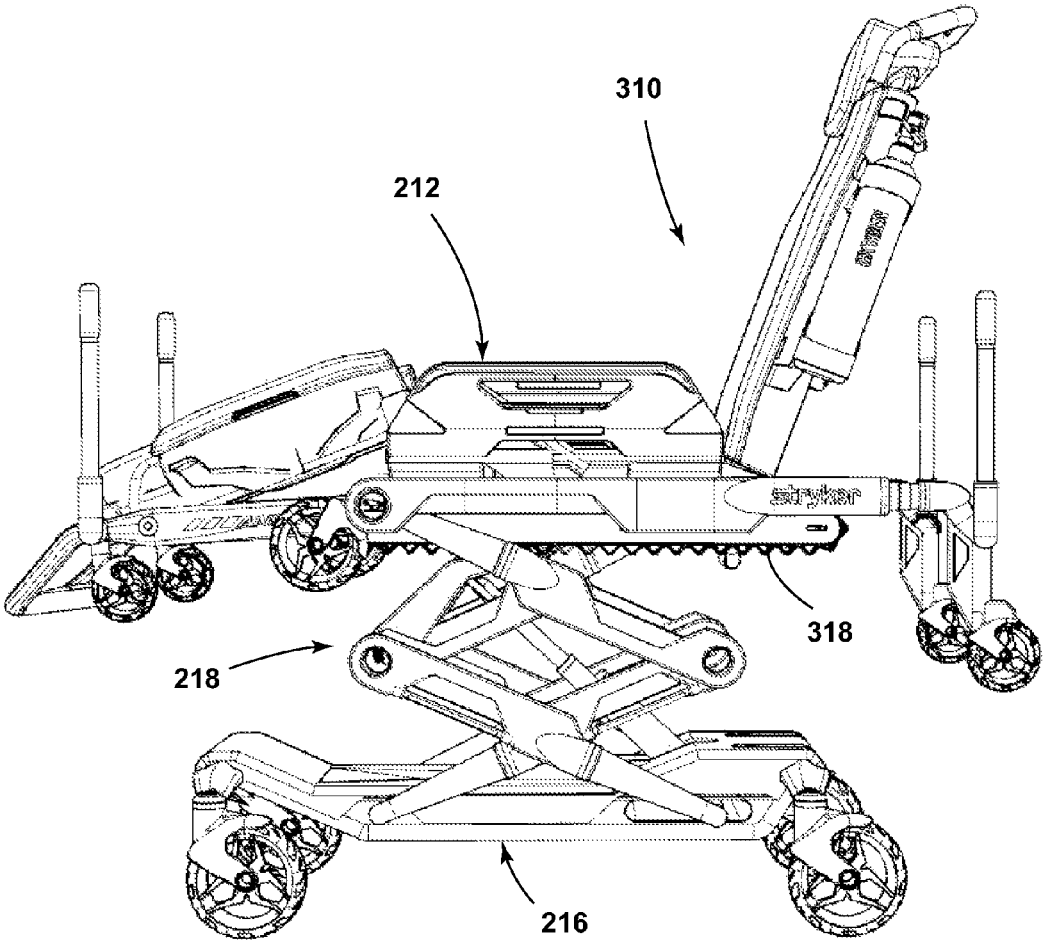
FIG. 39 is another side elevation view of the patient support system of FIG. 30 shown in a configuration for supporting a patient in a seated position.

Once mounted to the cot base, the deck may be positioned in a cot configuration as shown in FIGS. 34-37, or in a seated configuration such as shown in FIGS. 38 and 39.

To facilitate the transfer of chair 310 onto and off cot base 214, chair 310 may include hand holds, in the form of tubular handles at each of its head end and foot end. Further, to increase the length of the deck, deck 212 of chair 310 (similar to the previous embodiment) may include extendible foot and head rests. For details of how they could be mounted, reference is made to the description above.

In this manner, a single deck may be used both on a cot base and/or on a stair chair base. Furthermore, when the deck is moved as an assembly, with or with the entire stair chair structure, a patient supported on the deck may also be transferred.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A patient support comprising:

a base;

a deck for supporting a patient, said deck having a seat section, a head section articulatable relative to said seat section, and a foot section articulatable relative to said seat section, and said deck being reconfigurable between at least a flat configuration and a chair configuration wherein said foot section is folded downwardly and is generally vertical relative to said seat section;

a lift mechanism supporting said deck on said base, said lift mechanism operable to raise or lower said deck and configured to adjust the angular orientation of the deck while allowing the head section and the foot section to be articulated relative to said seat section, wherein said lift mechanism is coupled to said deck at foot end and head end pivot connections at said seat section only wherein each of said head section and said foot section is foldable relative to said seat section without interfering with said lift mechanism raising or lowering said deck; and a track, and said track being mounted to said base beneath said seat section laterally inward of said foot end and head end pivot connections of said lift mechanism, wherein when said deck is arranged in its chair configuration, said lift mechanism is operable to adjust the angular orientation of said deck relative to said base such that a patient supported on said deck maintains a generally seated position when said track is inclined while traveling over a variable angle surface.

2. The patient support according to claim 1, wherein said lift mechanism has a central pivot axis about which said lift mechanism collapses or extends to lower or raise said deck; and said patient support having a center of gravity extending through said central pivot axis when said deck is in a fully raised position and offset toward said head end when said deck is in a lowered position.

3. The patient support according to claim 1, wherein said lift mechanism comprises an X-frame lift mechanism.

4. The patient support according to claim 3, wherein said X-frame lift mechanism comprises a double X-frame lift mechanism having lower and upper pairs of X-frames, each of said pairs of X-frames having upper ends and lower ends, with the upper ends of said lower pair of X-frames pivotally coupled to respective lower ends of said upper pair of X-frames, and said upper ends of said upper pair of X-frames including said foot end pivot connections and said head end pivot connections.

5. The patient support according to claim 4, further comprising a frame supporting said deck, wherein said foot end pivot connections or said head end pivot connections are is pinned at said frame and the other of said foot end pivot connections or said head end pivot connections are slidably, pivotally mounted to said frame.

6. The patient support according to claim 5, wherein one pair of said lower ends of said lower pair of X-frames is pinned at said base and another pair of said lower ends of said lower pair of X-frames is slidably, pivotally mounted to said base and is beneath said upper ends of said upper pair of X-frames that are slidably, pivotally mounted to said frame.

7. The patient support according to claim 1, wherein said X-frames include telescoping legs to vary the angle of said seat section to thereby tilt said deck relative to said base.

8. The patient support according to claim 1, further comprising a drive mechanism, wherein said drive mechanism is operable to drive said track.

9. The patient support according to claim 1, further comprising a drive mechanism, wherein said drive mechanism is operable to extend or contract said lift mechanism.

10. The patient support according to claim 1, wherein said base includes a plurality of wheels and a pair of auxiliary wheels, each of said auxiliary wheels having a diameter larger than a diameter of each of said plurality of wheels, said auxiliary wheels providing increased maneuverability and stability to said patient support.

11. The patient support according to claim 10, further comprising a drive train for driving said patient support.

12. The patient support according to claim 11, said drive train driving said auxiliary wheels.

13. The patient support according to claim 1, wherein said deck is operable to tilt relative to said base at an angle in a range of 0 degrees plus or minus about 40degrees from horizontal.

14. The patient support according to claim 1, further comprising a user input device at said patent support and an electrically powered device at said patient support; and wherein said user input device is in wireless communication with said electrically powered device for wireless control of said electrically powered device.

* * * * *